US005998075A

United States Patent [19]

Fujiwara et al.

[11] Patent Number: 5,998,075

[45] Date of Patent: Dec. 7, 1999

[54] LIQUID DEVELOPER

[75] Inventors: Toshimitsu Fujiwara, Osaka; Hidetoshi Miyamoto, Takatsuki; Keyaki Yogome, Kyoto, all of Japan

[73] Assignee: Minolta Co., Ltd., Osaka, Japan

[21] Appl. No.: 09/335,267

[22] Filed: Jun. 17, 1999

[30] Foreign Application Priority Data

| | | | |
|---|---|---|---|
| Jun. 19, 1998 | [JP] | Japan | 10-173602 |
| Jun. 19, 1998 | [JP] | Japan | 10-173642 |
| Jun. 22, 1998 | [JP] | Japan | 10-174512 |
| Jun. 22, 1998 | [JP] | Japan | 10-174541 |
| Jun. 22, 1998 | [JP] | Japan | 10-174562 |

[51] Int. Cl.[6] ..... G03G 9/12; G03G 9/125; G03G 9/135

[52] U.S. Cl. ..... 430/106; 430/114; 430/115; 430/116

[58] Field of Search ..... 430/106, 114, 430/115, 116

[56] References Cited

U.S. PATENT DOCUMENTS

| | | | |
|---|---|---|---|
| 3,883,440 | 5/1975 | Tamai et al. | 430/114 |
| 4,033,890 | 7/1977 | Tamai et al. | 430/114 |
| 4,473,630 | 9/1984 | Yokoya et al. | 430/114 |
| 4,870,164 | 9/1989 | Kühne et al. | 534/742 |
| 4,935,502 | 6/1990 | Kühne et al. | 534/742 |
| 5,707,769 | 1/1998 | Hagi et al. | 430/106 |
| 5,712,068 | 1/1998 | Dalal et la. | 430/106 |
| 5,738,716 | 4/1998 | Santilli et la. | 106/31.77 |
| 5,837,754 | 11/1998 | Shimomura et al. | 523/161 |
| 5,843,605 | 12/1998 | Anno et al. | 430/106 |
| 5,851,713 | 12/1998 | Hayashi et al. | 430/111 |
| 5,928,419 | 7/1999 | Uemura et la. | 106/493 |

FOREIGN PATENT DOCUMENTS

| | | |
|---|---|---|
| 0 705 886 A2 | 4/1996 | European Pat. Off. . |
| 61-112160 | 5/1986 | Japan . |
| 63-2074 | 1/1988 | Japan . |
| 63-226660 | 9/1988 | Japan . |
| 7-140716 | 6/1995 | Japan . |
| 8-209017 | 8/1996 | Japan . |
| 8-234490 | 9/1996 | Japan . |

*Primary Examiner*—Roland Martin
*Attorney, Agent, or Firm*—Burns, Doane, Swecker & Mathis, LLP

[57] ABSTRACT

The invention provides the following liquid developers (1)–(5). (1) A liquid developer including a carrier liquid having an aniline point of 80° C. to 100° C.; and at least one compound selected from among Color Index Pigment Yellow 180, Color Index Solvent Yellow 162 and derivatives of these. (2) A liquid developer including a carrier liquid having an aniline point of 80° C. to 100° C.; toner; and at least one compound selected from among salicylic acid metal salt and derivatives thereof. (3) A liquid developer including a carrier liquid having an aniline point of 80° C. to 100° C.; toner; and at least one compound selected from among borate-containing compound and derivatives thereof. (4) A liquid developer including a carrier liquid; at least one compound selected from among an oil-soluble ionic surfactant having alkyl group(s) of at least 20 carbon atoms, and a copolymer of a monomer having a nitrogen-containing group and a long-chain (meth)acrylate; and toner containing at least one compound selected from among Color Index Pigment Yellow 180, Color Index Solvent Yellow 162 and derivatives of these. (5) A liquid developer including a carrier liquid; and toner containing Color Index Pigment Yellow 180 and having volume average particle size of 0.5 μm to 5 μm.

22 Claims, 1 Drawing Sheet

LIQUID DEVELOPER

The invention is based on patent application Nos. 10-173602 Pat., 10-173642 Pat., 10-174512 Pat., 10-174541 Pat. and 10-174562 Pat. filed in Japan, the contents of which are hereby incorporated by reference.

BACKGROUND OF THE INVENTION

1. Field of the Invention

The present invention relates to a liquid developer used for image formation, and particularly relates to an electrophotographic liquid developer which is used for developing electrostatic latent images in image forming apparatuses such as electrophotographic copying machines and printers.

2. Description of the Background Art

Electrophotographic image formation is generally performed as follows. An electrostatic latent image is formed, e.g., by effecting image exposure corresponding to an original image on an electrostatic latent image carrier such as a photosensitive member. The electrostatic latent image thus formed is developed into a visible toner image. This visible image is transferred onto and fixed on a record member so that an intended image is formed.

In the electrophotographic image formation, the developing method is classified into a dry developing method and a wet developing method.

In the dry developing method, a developer is formed of toner (coloring fine particles), or is formed of the toner and carrier which has magnetic properties and is added to the toner. If the dry toner used for dry development were excessively fine, the toner would flow into an ambient atmosphere and would float therein. Therefore, the toner which is usually used has a relatively large average particle diameter of about 10 $\mu$m or less.

In the wet developing method, the liquid developer which is now in the mainstream is formed of electrically insulating carrier liquid, in which toner primarily made of a coloring agent and binder resin as well as a charge director, a dispersion stabilizing agent and others are dispersed. It has been considered that the toner is charged owing to absorption of ions by virtue of the charge director, and the charged toner is used for development on the principle of electrophoresis. Since there is no possibility that the toner used in the wet development escapes into the atmosphere, fine toner can be used, and the available average particle diameter may be of the order of submicrons. Thereby, the produced image can have a high resolution and a good gray scale property.

An electrophoretic moving speed of the toner depends on the quantity of charges carried by the toner, and the developing speed can be increased with quantity of charges. As the quantity of charges increases, the dispersibilities of toner are improved, and the preservation properties of the liquid developer are improved. For improving the speed and stability of the wet developing system, therefore, it is necessary that the toner has a large quantity of charges.

With the increasing use of personal computers and others, it has been demanded that full-color images can be formed or duplicated by simple operations.

For forming the full-color image, offset printing has been employed as a method for formation or duplication of fine and beautiful full-color images. The offset printing allows fast production of high-quality images with a low cost, and therefore is suitable to large-volume printing. However, maintenance and operation of the offset printing apparatus are difficult.

In contrast to the above, electrophotographic copying machines, printers and others have such advantages that flexible image formation can be performed with easy operation. Compared with other printers of an ink-jet type or the like, the electrophotographic device is superior in printing speed, reproducibility and durability.

Year after year, higher qualities of full-color images have been required. For obtaining the high image quality substantially equal to or higher than that of the offset printing, it is suitable to employ the wet developing method which uses the toner of a small particle diameter and high chargeability.

For formation of the full-color image, precise control of the weight of toner developer is requiread in contrast to the mono-color image formation, and therefore it is necessary to stabilize the charge quantity of toner more sufficiently. Also, the high charge quantity is required for obtaining fine images of high resolutions.

For the above purpose, such a technique has been used in some cases that a charge control agent (CCA) is added to the dry developer for adding a high chargeability to the toner. As such charge control agent are known a salicylic acid metal salt and its derivative. The salicylic acid metal salt and its derivative provide negative charge to a toner. Since the salicylic acid metal salt and its derivative are white or colorless, they have no problem in providing a desired color to the toner and are suitable as a charge control agent for color developer. For example, Japanese patent No. 2625106 discloses a toner for dry developer containing the salicylic metal salt or its derivative as a charge control agent.

Further, a borate-containing compound has been known as the charge control agent. The borate-containing compound applies negative charges to the toner. Since many kinds of borate-containing compounds are colorless or light in color, they do not color the toner, and are suitable as the charge control agent for the developer of color images. For example, Japanese Patent Publication No. 8-10361 discloses the toner for dry development, which includes the borate-containing compound as the charge control agent.

However, if the salicylic acid metal salt or its derivative is used as the charge control agent for the toner in the liquid developer, such metal salt or its derivative is likely to dissolve in carrier liquid, i.e., organic solvent, and characteristics of the liquid developer may change with time. For example, dissolving of salicylic acid metal salt or its derivative lowers the chargeability of toner, and an ingredient dissolved in the carrier liquid causes lowering of the electric resistance of the carrier liquid or the like. For example, these disadvantages result in lowering of the developing speed, variations in image density, occurrence of image failures such as blur and/or dispersion in image, and condensation of toner during preservation.

If the borate-containing compound is; used as the charge control agent of the toner in the liquid developer, it is likely to dissolve in the carrier liquid (organic solvent) so that the characteristics of liquid developer may change with time. For example, dissolving of borate-containing compound causes lowering of the chargeability of toner, and an ingredient dissolved in the carrier liquid causes, for example, lowering of the electric resistance of the carrier liquid. These disadvantages result in, e.g., lowering of the developing speed, variations in image density, occurrence of image failures such as blur and/or dispersion in image and condensation of toner during preservation.

For forming the full-color images, developers of four colors, i.e., yellow, magenta, cyan and black are used similarly to the offset printing and others, and images each formed with the developer of the corresponding color are overlapped with each other by a subtractive color mixture method. If these developers of four colors are of a dry type, each developer can be produced by adding appropriate coloring pigment or dye as well as various additives, if necessary, to binder resin in a dispersed fashion, and thereby providing toner of a predetermined particle diameter. In the case of the liquid developer, the developer can be produced by dispersing such toner in the carrier liquid.

Among the toners of respective colors, the yellow toner is primarily formed of Color Index Pigment Yellow (which will also be referred to as "PY" hereinafter) 12, PY13, PY17, PY174, PY176 or the like, which has been widely used in conventional printing ink and others, because these pigments are preferable in view of coloring properties and cost.

However, the above Pigment Yellow contains organically bonded chlorine and heavy metal in the molecule. Therefore, it is proposed to use PY180 or Color Index Solvent Yellow (hereinafter may be referred to as SY) 162,. each of which is an azo compound containing no organically bonded chlorine and heavy metal and has excellent color forming ability almost same as conventional Pigment Yellow. PY180 is an azo pigment which has been known under the trade names of Novoperum-Gelb P-HG, Toner Yellow HG VP2155 and others. PY180 and dry toner containing the same are disclosed in U.S. Pat. Nos. 4,870,164 and 4,935,502, European patent application No. EP 0 705 886 A2 and others. SY162 is an azo dye which has been known under the trade names of Neopon Yellow 075 and others. SY162 and dry toner containing the same are disclosed in Japanese Laid-Open Patent Publication Nos. 61-112160, 7-140716 and 8-234490, and others.

However, if the above PY180, SY162 or derivative thereof is used as a coloring agent in the liquid developer, these are more likely to dissolve in the carrier liquid than the conventional yellow pigment. Depending on the types of the coloring agent and carrier liquid, therefore, characteristics of the liquid developer may change with time. For example, dissolving of the yellow coloring agent causes lowering of the chargeability of toner, and an ingredient dissolved in the carrier liquid causes lowering of the electric resistance of the carrier liquid or the like. These disadvantages result in lowering of the developing speed, variations in image density, occurrence of image failures such as blur and/or dispersion in image, condensation of toner during preservation and others.

In the liquid developer, the content of the coloring agent with respect to the binder resin in the toner is larger than that of the dry developer, and therefore the coloring agent affects the chargeability of toner to a higher extent. The toner of the liquid developer, of which coloring agent is formed of the foregoing PY180, SY162 or the derivative thereof, has a lower chargeability than the toner containing conventional yellow pigment, and therefore cannot achieve a practically required high developing speed without difficulty. In the liquid developer, the toner has a small particle diameter, and therefore a high toner chargeability is required for obtaining an intended developing speed. In the liquid developer using the foregoing PY180, SY162 or the derivative thereof as the toner coloring agent, it is unavoidable to increase the toner particle diameter for obtaining the intended toner chargeability, which results in a problem that high-resolution images cannot be formed.

If the foregoing PY180 is used as the coloring agent of the toner in the liquid developer, the pigment cannot disperse in the binder resin to an intended extent so that image failures such as blur or loss of color are likely to occur in final images. The PY180 may be directly dispersed in the carrier liquid without using the binder resin. In this case, however, PY180 cannot be dispersed in the carrier liquid to an intended extent, and is likely to be condensed or deposited.

SUMMARY OF THE INVENTION

Accordingly, an object of the invention is to provide a liquid developer, and particularly an electrophotographic liquid developer, which is superior in some points among the developing speed, density and quality of produced images, stabilities of them, preservability and others.

More specifically, an object of the invention is to provide an electrophotographic liquid developer for yellow, which can be used for formation of full-color images, and particularly an electrophotographic liquid developer, which is safe to the environment and others, can suppress change in chargeability with time, can stabilize an image quality, an image density, developing speed and others, and can provide good preservability.

Another object of the invention is to provide an electrophotographic liquid developer, which allows fast developing, can suppress change in toner chargeability with time, can suppress lowering of the image quality, image density, developing speed and others with time, and has good preservability.

Still another object of the invention is to provide an electrophotographic liquid developer for yellow which can be used for formation of a full-color image, and particularly an electrophotographic liquid developer which is safe to the environment, includes toner having sufficient chargeability and thereby allows fast development.

Yet another object of the invention is to provide an electrophotographic liquid developer for yellow which can be used for formation of a full-color image, and particularly an electrophotographic liquid developer which is safe to the environment, and can suppress occurrence of image failures such as blur and loss of color in a final image.

The invention provide the following five types of liquid developers:

(1) A liquid developer comprising:

carrier liquid having an aniline point between 80° C. to 100° C.; and at least one compound selected from among Color Index Pigment Yellow 180, Color Index Solvent Yellow 162 and derivatives of these.

The above liquid developer is an electrophotographic liquid developer for yellow, which can be used for formation of full-color images, and particularly an electrophotographic liquid developer, which is safe to the environment and others, can suppress change in chargeability with time, can stabilize an image quality, an image density, developing speed and others, and can provide good preservability.

(2) A liquid developer comprising:

a carrier liquid having an aniline point of 80° C. to 100° C.;

toner; and at least one compound selected from among salicylic acid metal salt and derivatives thereof.

This electrophotographic liquid developer allows fast developing, can suppress change in toner chargeability with time, can suppress lowering of the image quality, image density, developing speed and others with time, and has good preservability.

(3) A liquid developer comprising:

a carrier liquid having an aniline point of 80° C. to 100° C.;

toner; and at least one compound selected from among borate-containing compound and derivatives thereof.

This liquid developer likewise allows fast developing, can suppress change in toner chargeability with time, can suppress lowering of the image quality, image density, developing speed and others with time, and has good preservability.

(4) A liquid developer comprising:

a carrier liquid;

at least one compound selected from among an oil-soluble ionic surfactant having alkyl group(s) of at least 20 carbon atoms, and a copolymer of a monomer having a nitrogen-containing group and a long-chain (meth)acrylate; and toner containing at least one compound selected from among Color Index Pigment Yellow 180, Color Index Solvent Yellow 162 and derivatives of these.

This liquid developer is a liquid developer for yellow which can be used for formation of a full-color image, and particularly is a liquid developer which is safe to the environment, includes toner having sufficient chargeability and thereby allows fast development.

The above liquid developers are developed based on study by the inventors and knowledge of the inventors.

Many factors which affect the chargeability of toner in the liquid developer have been known. Generally, these known factors are, for example, surface characteristics of toner particles (e.g., a kind of functional group, a quantity, and an affinity with additives and others in the carrier liquid), a toner particle diameter (surface area), a quantity and a kind of a charge director, and other additives in the carrier liquid.

The surface characteristics of the toner particles are affected, e.g., by the kinds of the binder resin and the charge control agent added to the toner, and are also affected, e.g., by the kind of the coloring agent (dye and/or pigment) added to the toner as described before. The dye and pigment have many functional groups or portions capable of reaction. Since the dye and pigment are partially deposited on the surface of toners, the functional groups or portions capable of reaction are present on the toner surfaces. Even in the pigments or dyes of the same class, there are slight differences in kind and quantity of the functional groups and/or portions capable of reaction depending on manufacturers and grades of the pigments or dyes. This results in large variety of the chargeability of toner.

The mechanism of charging the toner particles in the wet developer does not rely on frictional charging which is utilized in the dry developer. It can be considered that the carrier liquid contains toner particles carrying a potential of a certain polarity as well as counter ions charged to the opposite polarity. In general, it is considered that a charge director added to the carrier liquid in the liquid developer serves as an agent for applying charges to the toner particles, and also serves as the counter ions.

More specifically, the following two mechanisms, which depend on the manner of reaction with the charge director, have been considered as the mechanism of charging the toner particles.

One of the mechanisms is based on the selective absorption of ions to the toner particles. The charge director added to the carrier liquid is in the state of solution, partially-dissolved solution or suspension. Many kinds of charge directors have portions containing nitrogen, portions containing polar group and others. Therefore, it is considered that the charge director dissolved in the carrier liquid is divided into a portion carrying positive charges and a portion carrying negative charges due to ion solution. According to this consideration, one kind of ions are selectively attracted onto the toner particles, and thereby charge the toner particles to the same polarity. It is also considered that the other kind of ions are present as the counter ions in the carrier liquid, and move in the direction opposite to that of the toner particles when an electric field is applied to the liquid developer. Assuming that the above theory is correct, such a portion must be present on the toner surface that significantly affects the absorption of ions caused by the charge director. The factors which significantly affect the absorption include the kind and quantity of the functional group such as a polar group of the dye or pigment which is partially exposed on the toner particle surface. The polar group and others of the dye and pigment exert a large influence on the chargeability of the toner particles.

The second theory about the mechanism of charging the toner particles is based on the transmission of charges (acid-base reaction) between the charge director and the toner particles. According to this theory, transmission of charges such as proton shift occurs at a portion where the charge director is in contact with the toner particles so that one of them is charged positively, and the other is charged negatively. For transmitting the charges similarly to the ion absorption theory described above, both the charge director and the toner particles must include the reactive portions, which are likely to release or accept the charges, according to this theory. The factors which significantly affect the release and acceptance of the charges include the kind and quantity of the functional group such as a polar group of the dye or pigment which is partially exposed on the toner particle surface. The polar group and others of the dye or pigment exert a large influence on the chargeability of the toner particles.

Whichever mechanism between the foregoing mechanisms is correct, the chargeability of the toner particles is significantly affected by the mutual action between the dye or pigment included in the toner and the charge director added to the carrier liquid. In the case where the conventional PY12, PY13, PY17, PY174, PY176 or the like was used as the yellow pigment, there was substantially no influence by the kind of the charge director, and almost all the known charge directors could provide good toner chargeability.

It was also found that, in the case where PY180, SY162 or derivative thereof was used as the coloring agent, the toner chargeability could be increased by appropriately selecting the kind of charge director. Although the reason for this is not clear, it can be considered that the toner surface has restricted special characteristics if PY180, SY162 or the like is used. If such a pigment or dye is used, good toner chargeability can be achieved by employing, as the charge director, the oil-soluble ionic surfactant having alkyl group(s) of at least 20 carbon atoms, and/or the copolymer of the monomer having the nitrogen-containing group and the long-chain (meth)acrylate.

(5) The liquid developer comprising:

carrier liquid; and toner including Color Index Pigment Yellow 180, and having a volume average particle diameter in a range from 0.5 $\mu$m to 5 $\mu$m.

This liquid developer is an liquid developer for yellow which can be used for formation of a full-color image, and particularly an liquid developer which is safe to the environment, and can suppress occurrence of image failures such as blur and loss of color in a final image.

This liquid developer according to the invention is based on the following knowledge.

In the toner which is generally used and has a volume average particle diameter smaller than 0.5 μm, the secondary particle diameter of PY180, which is defined by gathering of PY180 having a particle diameter between 0.1 μm and 0.2 μm, is approximately equal to the toner particle diameter. Accordingly, even if PY180 is sufficiently mixed and dispersed in the binder resin, some of the toner particles, which are then formed by crushing the mixture, do not contain the pigment so that blur or loss of color occurs in the final image.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
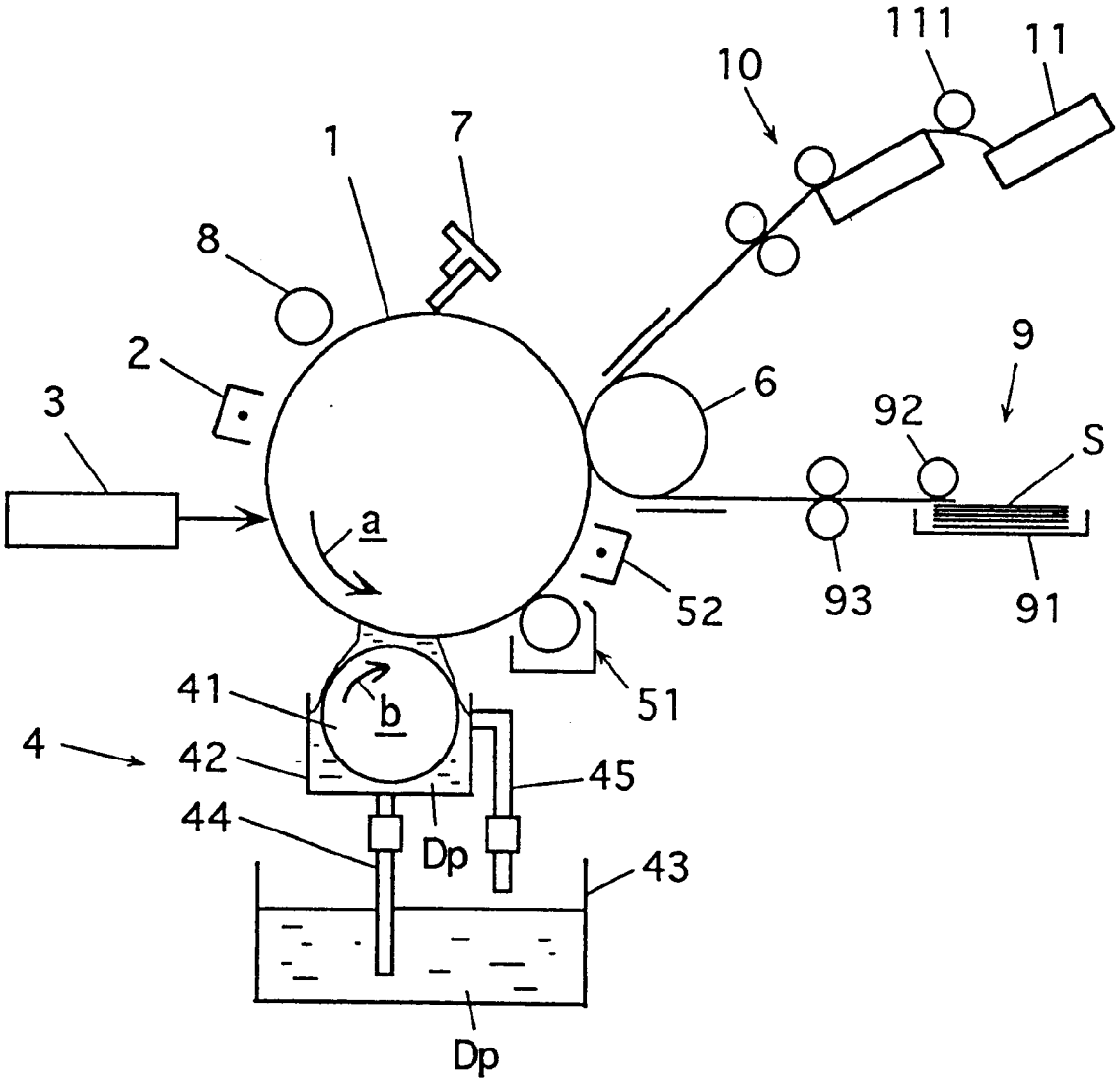
FIG. 1 shows by way of example a schematic structure of an experimental apparatus for image formation.

As liquid developers of the preferred embodiments of the invention, description will be given on the following five types of electrophotographic liquid developers.

(1) First Liquid Developer

A first electrophotographic liquid developer includes electrically insulating carrier liquid and toner dispersed in the carrier liquid. The toner includes, as a coloring agent, a compound classified as Color Index Pigment Yellow 180 (PY180) and/or its derivative. Alternatively, the toner includes Color Index Solvent Yellow 162 (SY162) and/or its derivative as a coloring agent. The carrier liquid has an aniline point in a range from 80° C. to 100° C.

In the specification and the appended claims, the aniline point is a minimum temperature where a mixture of same volumes of aniline and hydrocarbon compound exist as a homogeneous solution and has a close relation with a kind of hydrocarbon compound.

In the first electrophotographic liquid developer, the coloring agent for the yellow toner is formed of the compound classified as PY180, the compound classified as SY162 or the like, each of which contains neither organically bonded chlorine nor heavy metal. Therefore, the liquid developer does not adversely affect the environment and others, and is safe. Since these coloring agents have good coloring properties, beautiful colors can be achieved in a full-color image.

Since the liquid having the aniline point of 80° C. or more is used as the carrier liquid, it is possible to suppress dissolution of the compound, which is classified as PY180, or the compound classified as SY162 or the like into the carrier liquid. This suppresses lowering of the chargeability of the toner, and also suppresses, e.g., lowering of the electric resistance value of the carrier liquid, which may be caused by the ingredient dissolved in the carrier liquid. As a result, it is possible to suppress disadvantages such as lowering of the developing speed, change in image density, image failures such as image blur and dispersion, and condensation of toner during preservation. The aniline point of the carrier liquid is restricted to 100° C. or less. The reason for this is as follows. A solvent having a higher aniline point than another solvent of homologous series has a larger molecular weight and a larger viscosity. Therefore, the upper limit of the aniline point is determined as described above for the purpose of avoiding excessive lowering of the developing speed which may be caused by rise in viscosity of the carrier liquid. The aniline point of the carrier liquid is preferably in a range from 80° C. to 90° C.

The first liquid developer can be manufactured, e.g., by the following manner.

First, the melted binder resin and the coloring agent are kneaded to disperse the coloring agent in the resin.

One or more of the compound classified as PY180, the compound classified as SY162 and derivatives thereof is used as the coloring agent. More specifically, Novoperum-Gelb P-HG, Toner Yellow HG VP2155 or the like may be used as PY180, and Neopen Yellow 075 or the like may be used as SY162. These coloring agents may be added at a rate in a range from 3 wt % to 30 wt % with respect to the binder resin, although the specific rate depends on a particular use, a thickness of the toner layer and others. Preferably, the rate is substantially in a range from 5 wt % to 20 wt %. If the addition rate of coloring agent with respect to the binder resin were smaller than 3 wt %, sufficient coloring might not be achieved. If the addition rate of coloring agent with respect to the binder resin were larger than 30 wt %, the coloring agent might not be dispersed sufficiently in the toner, and/or the toner image transferred onto the record member might not be fixed sufficiently by the heat, in which case it would be unavoidable to reduce the fixing speed.

Various kinds of resin can be used as the binder resin for the toner particles provided that the resin has a thermal plasticity and do not substantially dissolve in the carrier liquid. For example, the binder resin may be thermoplastic saturated polyester resin, styrene/acrylic copolymer resin, styrene/acryl-modified polyester resin, polyolefin copolymer resin (particularly, ethylenic copolymer) epoxy resin, rosin-modified phenol resin or rosin-modified maleic acid resin. These are used singly or in a mixture. With the binder can be blended, as required, a resin such as paraffin wax, polyolefin or the like as a mold releasing agent in an amount up to 20 wt %. Particularly preferable is a thermoplastic saturated polyester resin or ethylenic copolymer.

The thermoplastic saturated polyester resin can widely change the characteristics of substance such as thermal characteristics, and further can provide beautiful coloring owing to its good transparency for the color image. Moreover, the thermoplastic saturated polyester resin has good ductility and malleability as well as good viscoelasticity so that the fixed resin film can be strong, and can be sufficiently adhered to the record member such as a sheet of paper.

More specifically, the thermoplastic saturated polyester resin is prepared by a polycondensation reaction of polyalcohol and polycarboxylic acid.

Examples of polyalcohol are alkylene glycols (aliphatic glycols) such as ethylene glycol, diethylene glycol, triethylene glycol, 1,2-propylene glycol and like propylene glycols, dipropylene glycol, 1,4-butanediol and like butanediols, neopentyl glycol, 1,6-hexanediol and like hexanediols, alkylene oxide adducts of these alkylene glycols; phenolic glycols such as bisphenol A, hydrogenated bisphenol and like bisphenols, alkylene oxide adducts of these phenolic glycols; aliphatic or aromatic diols such as monocyclic or polycyclic diols; and triols such as glycerin and trimethylolpropane. The polyalcohols are not limited to the above and can be used singly or in a mixture of at least two of them.

Particularly, neopentyl glycol and adduct of bisphenol A and 2–3 moles of alkylene oxide are suitable as the toner binder resin of the liquid developer in view of the solubility and stability of the produced polyester resin, and are also preferable in view of low cost. Examples of alkylene oxides are ethylene oxide and propylene oxide.

Examples of polycarboxylic acids are saturated or unsaturated dibasic acids such as malonic acid, succinic acid, adipic acid, azelaic acid, sebasic acid, fumaric acid, maleic acid, itaconic acid, phthalic acid and its modified acid (e.g., hexahydrophthalic anhydride), isophthalic acid, terephthalic acid; saturated polybasic acids of at least three functionalities such as trimellitic acid, pyromelltic acid and methyl nadic acid; and acid anhydrides and lower alkyl esters of these polycarboxylic acids. The polycarboxylic acids are not limited to the above and can be used singly or in a mixture of at least two of them.

The isophthalic acid and terephthalic acid are particularly suitable for use as the binder resin for toner of the liquid developer in view of the solubility and stability of the produced polyester resin, and are also preferable in view of low cost.

Conventional known polycondensation reactions are usable as a method of polycondensation. The polycondensation is usually conducted at about 150° C. to 300°C., although depending on the kinds of starting monomer. Polycondensation can be performed under various conditions, for example, using an inert gas as atmosphere gas, various solvents, and/or a normal pressure or a reduced pressure within a reaction vessel. Further, an esterification catalyst can be used for accelerating the reaction. As an esterification catalyst are usable organic metal compounds such as tetrabutylzirconate, zirconium naphthenate, tetrabutyltitanate, tetraoctyltitanate and 3/1 stanous oxalate/sodium acetate. Preferable are those which do not color the ester produced. Alkyl phosphite and aryl phosphite are usable as a catalyst or color adjuster.

It is possible to control a molecular weight of polyester resin by controlling a polymerization temperature and a reaction pressure. Further, a desired acid value of polyester resin is obtained by controlling a mixing ratio of polyalcohol and polycarboxylic acid or a molecular weight of polyester resin.

Ethylenic copolymers include ethylene/acrylic acid copolymer, ethylene/methacrylic acid copolymer, ethylene/acrylic ester copolymer, ethylene/methacrylic ester copolymer, ethylene/vinyl acetate copolymer, terpolymer of ethylene/acrylic acid or methacrylic acid/acrylic ester or methacrylic ester, ethylene/maleic anhydride copolymer, terpolymer of ethylene/acrylic acid or methacrylic acid/maleic anhydride and partially metal ion crosslinked ethylene/acrylic acid or methacrylic acid copolymer (ionomer resin).

The coloring mixture is formed of the binder resin thus obtained, the compound classified as the coloring agent PY180, the compound classified as SY162 or the like, and the charge control agent added if necessary. This mixture is roughly crushed by a cutter mill, jet mill or the like. Wet grinding processing is effected on the roughly crushed toner in a small amount of carrier liquid in which a charge director is dissolved. Thereby, the toner is further crushed to form a high-concentration liquid developer in which the toner has a particle diameter in a range from about 0.1 $\mu$m to 10 $\mu$m, and more preferably in a range from about 0.5 $\mu$m to 5 $\mu$m. The high-concentration liquid developer thus obtained is diluted with the carrier liquid containing the charge director, if necessary, so that the liquid developer having an appropriate toner concentration is obtained.

The carrier liquid has a resistance value in a range from about $10^{11}$ Ω·cm to $10^{16}$ Ω·cm which does not disturb the electrostatic latent image. The carrier liquid at the room temperature may be in any state provided that the carrier liquid is in the liquid state when it is heated to a temperature higher than the softening point of the dispersed resin in the developing operation. Preferably, it also has a boiling point which allows easy drying after the fixing process. Further, it is preferable that the solvent emits no foul odor, is nonpoisonous and has a relatively low inflammation point.

As a carrier liquid may be aliphatic hydrocarbon, alicyclic hydrocarbon, aromatic hydrocarbon, halogenated hydrocarbon, polysiloxane and others. Among them, normal paraffin solvent and iso paraffin solvent are preferable particularly in view of odor, harmlessness and cost. Examples of these solvents are 0 grade Solvent L, 0 grade Solvent M, 0 grade Solvent H (each, Nippon Petrochemicals Co., Ltd.), Isoper C, Isoper E, Isoper G, Isoper H, Isoper L, Isoper M, Isoper K, Isoper V (each, Exon), Shellsol 71 (Shell Oil Co., Ltd.), IP Solvent 1016, IP Solvent 1620, IP Solvent 2028, IP Solvent 2835 (each, Idemitsu ), Nisseki Isozol 200, Nisseki Isozol 300, Nisseki Isozol 400 (each, Nippon Petrochemicals Co., Ltd.).

The first liquid developer described above as well as second and third liquid developer, which will be described later, use as the carrier liquid such solvent that has an aniline point in a range from 80° C. to 100° C., and more preferably in a range from 80° C. to 90° C.

The carrier liquid having the aniline point in the above range can be formed of a single kind of solvent selected from the foregoing hydrocarbon solvents or a combination of two or more of them. Among the foregoing hydrocarbon solvents, the above conditions are satisfied by 0 grade Solvent L, 0 grade Solvent M, 0 grade Solvent H, Isoper G, Isoper H, Isoper L, Isoper M, IP Solvent 1620, IP Solvent 2028 and others. In particular, it is preferable to use 0 grades Solvent L, 0 grade Solvent M, Isoper G, Isoper H, Isoper L or IP Solvent 1620.

The charge director is substantially solvated or dissolved in the carrier liquid, and is added for the purpose of affecting the quantity of charges of the toner particles. If necessary, the charge director may be added into the toner particles.

Most preferable charge director is the following oil-soluble ionic surfactant. Examples thereof are alkylbenzenesulfonic acid salt having alkyl group(s) of at least 20 carbon atoms (calcium salt, barium salt, etc.), petroleum sulfonic acid salt [barium salt, calcium salt, magnesium salt, etc., and basic petroleum sulfonic acid salt (barium salt, calcium salt, magnesium salt, etc.)]. Particularly preferable are petroleum sulfonic acid salt [barium salt, calcium salt, and basic petroleum sulfonic acid salt (barium salt, calcium salt)].

Examples of commercially available charge directors are Sulfol Ca-45N, Sulfol Ca-45, Sulfol 1040, Molescoamber SC-45N, Molescoamber SC-45, Sulfol Ba-30N, Molescoamber SB-50N (all manufactured by Matsumura Oil Research Corp.), Basic Barium Petronate, Neutral Barium Petronate, Basic Calcium Petronate, Neutral Calcium Petronate, Basic Magnesium Petronate (all manufactured by Witco Chemical Co., Ltd.), and others.

In addition to the above, the following substances (a), (b) and (c) which are known as the charge director for the toner may be used.

(a) A polymer or copolymer having nitrogen-containing monomer as a component and soluble in the carrier liquid. Specific examples are a polymer having as a component a monomer such as (meth)acrylates having an aliphatic amino group, vinyl monomers having nitrogen-containing heterocyclic ring, cyclic amide monomers having N-vinyl substituent, (meth)acrylamides, aromatic substituted ethylenic monomers having nitrogen-containing group, nitrogen-containing vinyl ether monomers, etc. Particularly preferable is a copolymer which is soluble in a hydrocarbon carrier liquid and containing a monomer such as hexyl (meth)acrylate, cyclohexyl (meth)acrylate, 2-ethylhexyl (meth)acrylate, octyl (meth)acrylate, nonyl (meth)acrylate, decyl (meth)acrylate, dodecyl (meth)acrylate, lauryl (meth) acrylate, stearyl (meth)acrylate, vinyl laurate, vinyl stearate, benzyl (meth)acrylate and pheny (meth)acrylate.

(b) Ionic surfactant composed of organic acid metal salt, for example, metal salt of aliphatic acid such as naphthenic acid, octenoic acid, oleic acid and stearic acid; metal salt of dialkylsulfosuccinic acid; metal salt of alkylbenzenesulfonic acid having alkyl group of up to 19 carbon atoms; metal salt of alkylphosphate; metal salt of abietic acid or hydrogenated abietic acid.

(c) Amphoteric surfactant such as lecithin, natural fats and oils such as linseed oil.

Each of the foregoing charge directors may be used solely, or two or more of them may be used in a mixed fashion. The charge director may be added at a rate in a range from about 0.01% to 100% by weight with respect to the toner, although the appropriate value specifically depends on the intended chargeability.

A dispersant (dispersion stabilizer) may be used for stabilizing dispersion of toner particles in the liquid developer. The dispersant (dispersion stabilizer) may be, e.g., a polymer which is absorbed onto the toner particles, has affinity to the carrier liquid, completely or partially dissolves in the carrier liquid or swells with the carrier liquid.

These polymers are not specifically limited, but may include polyolefin type petroleum resin, linseed oil and poly(alkylmethacrylate). In order to enhance affinity to the toner particle, it is possible to use a copolymer containing a monomer having a polar group such as methacrylic acid, acrylic acid and alkylaminoethyl methacrylate. In this case, solubility to the carrier liquid, affinity and adsorption to the toner particle are controlled by an amount of the polar group copolymerized. The larger the amount of the polar group, the lesser the solubility to the carrier liquid and the more the affinity and adsorption to the toner particle.

The dispersant is preferably added to the carrier liquid at the rate from 0.01% to 20% by weight for improving the dispersibility and preventing rise in viscosity of the carrier liquid due to addition of the dispersant. More preferably, the rate is substantially in a range from 0.1% to 10% by weight.

A rate of the total weight of the solid components such as the toner, charge director and dispersant with respect to the total weight of the liquid developer is preferably in a range from about 1% to 90% by weight. For the purpose of reducing the total amount of the liquid developer used for the developing, and thereby facilitating the handling, the total rate of the solid components is more preferably in a range from 2% to 50% by weight.

Specific examples of the first liquid developer will now be described below.

The first liquid developer according to the invention is not restricted to the following examples.

In the following description, "parts" represents "weight parts", and "Tg" represents a "glass transition temperature" unless otherwise specified. "Mn" represents a number average molecular weight, and "Mw" represents a weight average molecular weight.

In the following description, the number average molecular weight (Mn) and the weight average molecular weight (Mw) were obtained from the result of gel permeation chromatography (GPC), which was performed with a high speed liquid chromatograph pump TRI ROTAR-V type (manufactured by Nippon Bunkou Co., Ltd.), an ultraviolet spectrometer UVIDEC-100-V type (manufactured by Nippon Bunkou Co., Ltd.) and a 50 cm-long column Shodex GPC A-803 (manufactured by Showa Denko Co., Ltd.). The weight average molecular weight (Mw) was obtained as the weight average molecular weight (Mw) in term of polystyrene from the result of the chromatography, and more specifically by adopting polystyrene as the standard substance and calculating the molecular weight of the test sample. The number average molecular weight (Mn) was likewise obtained from the result of the chromatography. The test sample was prepared by dissolving 0.05 g of binder resin in 20 ml of tetrahydrofuran (THF).

The glass transition temperature (Tg) was measured by a differential scanning calorimeter DSC-20 (manufactured by Seiko Denshi Kogyo Co., Ltd.) under the conditions of the sample quantity of 10 mg and the temperature rising speed of 10° C./min. The standard substance was powder of alpha-alumina. The temperature of the test sample was once raised to a value higher than Tg, and then was lowered. Thereafter, the temperature was raised to a value higher than Tg again, and the raised temperature was kept for ten minutes. Thereafter, the value of Tg was measured with the second RUN.

The acid value was measured under the conditions specified by JIS K5400, and the volume average particle diameter was measured with the laser diffraction particle distribution measuring device SALD-1100 (manufactured by Shimazu Seisakusho Co., Ltd.).

The foregoing description made on the "parts" in the weight parts as well as the manners of obtaining the molecular weights Mw and Mn, glass transition temperature, acid value and others are also true with respect to second to fifth liquid developers which will be described later.

Preparation of Binder Resin (1) A polyester resin used in experimental examples, which will be described later, were prepared as follows.

To a round bottom flask equipped with a reflux condenser, separator of water and alcohol, nitrogen gas introducing tube, thermometer and stirrer were placed 1450 parts of bisphenol A-ethylene oxide adduct and 890 parts of isophthalic acid. The mixture was heated at 200° C. to 240° C. with introducing nitrogen gas and stirring to conduct polycondensation reaction with dehydration. When an acid value of the polyester resin thus formed or a viscosity of the reaction solution reached a desired value, the reaction mixture was cooled to or below 100° C. to terminate the polycondensation reaction. Thus, a thermoplastic saturated polyester resin was obtained.

The polyester resin thus formed was 6500 in Mw, 2500 in Mn, 55.1° C. in Tg and 25.0 mgKOH/g in acid value.

(2) As an ethylenic resin was used a thermoplastic ethylene/ethyl acrylate resin ELVACITE (E. I. duPont de Nemours and Company).

Experimental examples of manufacturing of the first liquid developer are as follows.

EXPERIMENTAL EXAMPLE 1

A mixture of 60 parts of the polyester resin and 40 parts of the coloring agent, i.e., PY180 (Toner Yellow HG VP2155 manufactured by Clariant Co., Ltd.) was kneaded at 180° C. for four hours by a kneader with three rolls, and thereby a high-concentration coloring agent mixture was prepared. This high-concentration coloring agent mixture was diluted with the foregoing polyester resin by a kneader, and finally a coloring resin mixture containing 15 wt % of PY180 was prepared. After being sufficiently cooled, this coloring resin mixture was roughly crushed by a cutter mill, and then was finely crushed by a jet mill (Nippon Pneumatic Kogyo Co., Ltd.) to produce coloring toner rough particles having an average particle diameter of about 10 μm. Thirty grams of the coloring toner rough particles were mixed with 70 grams of 0 grade solvent L (aniline point of 80.4° C.) containing 0.5 wt % of barium salt of petroleum sulfonic acid Sulfol Ba-30N (Matsumura Oil Reseach Corp.). Wet grinding was effected on this mixture by performing processing for 15 hours with a sand grinder (IGARASHI KIKAI SEIZO Co., Ltd.), a media formed of 150 cc of glass beads having a diameter of 1 mm, a ⅛-gallon vessel with water-jacket, a cooling water temperature of 20° C. and a disk rotation speed of 2000 rpm. In this manner, the high-concentration liquid developer having a volume average toner particle diameter of 1.52 μm was prepared.

The high-concentration liquid developer was diluted by adding 900 parts of 0 grade Solvent L solution containing 0.5 wt % of Sulfol Ba-30N to 100 parts of the above high-concentration liquid developer. Dispersing processing was effected on this mixture by a dispersing device T. K. autohomomixer M-type (Tokushu Kikai Kogyo Co., Ltd.) with 10000 rpm for 5 minutes. Thereby, the liquid developer 1 was produced.

EXPERIMENTAL EXAMPLE 2

A liquid developer 2 was produced in the same manner as the experimental example 1 except for that SY162 (Neopen Yellow 075 manufactured by BASF Co., Ltd.) was used instead of PY180 as the coloring agent in the above experimental Example 1.

EXPERIMENTAL EXAMPLE 3

A liquid developer 3 was produced in the same manner as the experimental example 1 except for that the ethylene/ethyl acrylate resin was used instead of the polyester resin as the binder resin.

EXPERIMENTAL EXAMPLE 4

A liquid developer 4 was produced in the same manner as the experimental example 1 except for that SY162 was used instead of PY180 as the coloring agent, and 0 grade Solvent H (aniline point of 90.4° C.) was used instead of 0 grade Solvent L (aniline point of 80.4° C.) as the carrier liquid.

EXPERIMENTAL EXAMPLE 5

A liquid developer 5 was produced in the same manner as the experimental example 1 except for that Isoper G (aniline point of 80° C.) was used instead of 0 grade solvent L (aniline point of 80.4° C.) as the carrier liquid.

EXPERIMENTAL EXAMPLE 6

A liquid developer 6 was produced in the same manner as the experimental example 1 except for that SY162 was used instead of PY180 as the coloring agent, and Isoper L (aniline point of 86° C.) was used instead of 0 grade Solvent L (aniline point of 80.4° C.) as the carrier liquid.

EXPERIMENTAL EXAMPLE 7

A liquid developer 7 was produced in the same manner as the experimental example 1 except for that Isoper M (aniline point of 88° C.) was used instead of 0 grade Solvent L (aniline point of 80.4° C.) as the carrier liquid.

EXPERIMENTAL EXAMPLE 8

A liquid developer 8 was produced in the same manner as the experimental example 1 except for that SY162 was used instead of PY180 as the coloring agent, and IP Solvent 1620 (aniline point of 81° C.) was used instead of 0 grade Solvent L (aniline point of 80.4° C.) as the carrier liquid.

EXPERIMENTAL EXAMPLE 9

A liquid developer 9 was produced in the same manner as the experimental example 1 except for that IP Solvent 2028 (aniline point of 89° C.) was used instead of 0 grade Solvent L (aniline point of 80.4° C.) as the carrier liquid.

EXPERIMENTAL EXAMPLE 10

A liquid developer 10 was produced in the same manner as the experimental example 1 except for that Isoper E (aniline point of 74° C.) was used instead of 0 grade Solvent L (aniline point of 80.4° C.) as the carrier liquid.

EXPERIMENTAL EXAMPLE 11

A liquid developer 11 was produced in the same manner as the experimental example 1 except for that SY162 was used instead of PY180 as the coloring agent, and IP Solvent 1016 (aniline point of 72° C.) was used instead of 0 grade Solvent L (aniline point of 80.4° C.) as the carrier liquid.

EXPERIMENTAL EXAMPLE 12

A liquid developer 12 was produced in the same manner as the experimental example 1 except for that IP Solvent 2835 (aniline point of 104° C.) was used instead of 0 grade Solvent L (aniline point of 80.4° C.) as the carrier liquid.

Then, description will be given on evaluation which was made on the liquid developers 1–12, and particularly on the charge stability of the toner and the developing speed.

The charge stability was evaluated by measuring changes in zeta potential (ζ-potential) of the liquid developer over time. The zeta potential in the system, where particles having surface charges are dispersed in the liquid, represents the potential on the electrostatic double layer at the particle surface, and the zeta potential in the liquid developer is a value related to the chargeability of the toner. The change in zeta potential (ζ-potential), and particularly the reduction in absolute value thereof results in lowering of the dispersibility of the toner, lowering of the developing speed, change in image density and others.

The zeta potential was calculated from the particle speed, which was measured with a zeta potential measuring instrument LAZER ZEE MODEL 501 and a non-aqueous measuring system for PEN KEM 501 (both manufactured by PEN KEM Co., Ltd.) in such a manner that toner particles are subjected to a voltage and thereby migrate, and a laser for observation is emitted to the toner particles for measuring the particle speed. Each sample was prepared by diluting the foregoing liquid developer with 100 parts of carrier solution containing 0.5 wt % of Sulfol Ba-30N.

The zeta potential of each liquid developer was measured immediately after the production and after being kept at a room temperature for one week, and was determined based on decrease rate thereof as follows:

less than 10%: good (O)

10% or more but less than 20%: relatively good (Δ)

20% or more: bad (X)

The value determined as good or relatively good is in a practically allowed range.

The evaluation of the developing speed was performed by actual image forming tests using the respective liquid developers and an experimental image forming apparatus having a schematic structure shown in FIG. 1.

The experimental image forming apparatus shown in FIG. 1 is of an electrophotographic type, and is internally provided with a liquid developing device. The apparatus in FIG. 1 has a photosensitive drum 1, and also includes a charger 2, an image exposing device 3 for emitting a laser beam based on an image data sent from a host computer or the like (not shown), a liquid developing device 4, a squeeze roller device 51, a squeeze charger 52, a transfer roller 6, a cleaner 7 and an eraser lamp 8, which are successively arranged around the photosensitive drum 1. Near the transfer roller 6, there are arranged a sheet supply device 9, a fixing device 10 which includes a thermal fixing roller pair for fixing a toner image formed on the sheet, and a discharged sheet tray 11 for receiving sheets discharged from the apparatus. A sheet discharge roller 111 is provided for the discharged sheet tray 11. The sheet supply device 9 includes a sheet cassette 91 accommodating the record sheets S, and a feed roller 92 for feeding the sheets from the cassette 91. A timing roller pair 93 is arranged between the sheet supply device 9 and the transfer roller 6.

The liquid developing device 4 includes a developing roller 41 which is opposed to the photosensitive drum 1 with a minute space therebetween, and has a lower portion immersed in the liquid developer Dp, a developer retaining tank 42 for retaining the liquid developer Dp around the developing roller 41, a developer reservoir 43 for reserving the liquid developer Dp to be supplied to the developer retaining tank 42, a liquid developer supply device 44 which scoops and supplies the developer Dp in the developer reservoir 43 to the developer retaining tank 42, and a developer collecting device 45 which returns the surplus developer in the developer retaining tank 42 to the developer reservoir 43. The developer Dp in the developer reservoir 43 is appropriately supplied with high-concentration toner liquid from a high-concentration toner supply device (not shown) and thereby keeps a substantially constant toner concentration. A developing gap between the developing roller 41 and the photosensitive drum 1 can be freely adjusted within a range from 0 mm to 2 mm.

For the image formation, the photosensitive drum 1 rotates in a direction of an arrow a in FIG. 1 at a speed of 20 cm/sec–80 cm/sec, and the charger 2 uniformly charges the surface of the photosensitive drum 1 to carry a surface potential of about −500 V. The image exposing device 3 emits the laser beams based on the image information to the photosensitive drum 1 so that an electrostatic latent image is formed on the surface of the photosensitive drum 1. About 30% of the whole surface area of the photosensitive drum 1 is exposed. The surface potential of the exposed portion of the photosensitive drum 1 is lowered to about −30 V.

The electrostatic latent image formed on the photosensitive drum 1 is visualized with the liquid developer by the liquid developing device 4. The developing roller 41 rotates at a rotating speed 1.5 times larger than that of the photosensitive drum 1 in a direction of an arrow b in the figure, which is opposite to the rotating direction of the photosensitive drum 1. A developing gap of 100 $\mu$m is kept between the photosensitive drum 1 and the developing roller 41. A bias potential of about −400 V is applied to the developing roller 41 for promoting adhesion of the developer onto the exposed portion and suppressing adhesion of the developer onto the unexposed portion.

Thereafter, the squeeze roller device 51, which rotates in the same direction as the photosensitive drum 1, and the squeeze charger 52 squeeze and remove the surplus liquid developer adhered onto the photosensitive drum 1, and the toner image containing a slight amount of the liquid is formed on the surface of the photosensitive drum 1. The toner image thus formed moves to a transfer position opposed to the transfer roller 6. In the transfer position, the toner image comes into contact with the paper sheet transferred from the sheet supply device 9, and is electrostatically transferred onto the sheet. The transfer roller 6 carries a transfer voltage of +1000 V.

The transfer sheet is separated from the photosensitive drum 1, and then is sent to the fixing device 10 which includes a thermal fixing roller pair heated to 150° C. The fixing device 10 fixes the image by the heat and pressure so that image formation on the sheet is completed. The sheet is then discharged by the discharge roller 111 onto the discharged sheet tray 11. After the image transfer to the sheet, the cleaner 7 removes the residual liquid developer on the surface of the photosensitive drum 1, and the eraser lamp 8 removes the residual charges on the photosensitive drum 1 for the next image formation.

The developing speed achieved by the apparatus shown in FIG. 1 was evaluated as follows:

An electrostatic latent image, which has a belt-like form, and is 20 cm in the longitudinal direction (parallel to the rotation axis of the photosensitive drum 1) and 5 cm in the peripheral direction, was formed on the photosensitive drum 1, and was visualized to provide a belt-like image of 20 cm by 5 cm. Reflection density was measured by a densitometer PDM5 (SAKURA Co., Ltd.) at three portions of the band-like image. These portions are all located in the center with respect to the rotating direction of the photosensitive drum, and are respectively located at the longitudinally central position and the positions spaced in the longitudinal direction by 5 cm from the opposite ends, respectively. An average was obtained from the values measured at these portions. In this measurement, the images were formed at various rotation speeds of the photosensitive drum 1, which were in a range from 20 cm/sec to 80 cm/sec. The evaluation was made based on the maximum rotation speeds of the photosensitive drum 1, at which the averages of the reflection densities at the foregoing portions were 2 or more, i.e., practically sufficient value. More specifically, the evaluation based on the maximum rotation speed was made as follows:

70 cm/sec or more: good (O)

40 cm/sec or more, but lower than 70 cm/sec: relatively good (Δ)

lower than 40 cm/sec bad (X)

The values determined as good or relatively good are in the practically allowed range.

The following list shows the results of evaluation of the toner charge stability and the developing speed of the respective liquid developers.

| | Aniline Point | Zeta Potential IM* | 1 week* | R/C* | Evaluation | |
|---|---|---|---|---|---|---|
| | (° C.) | (mV) | (mV) | (%) | C/S* | D/S* |
| EX* 1 | 80.4 | −93 | −90 | 4 | ○ | ○ |
| EX* 2 | 80.4 | −91 | −85 | 6 | ○ | ○ |
| EX* 3 | 80.4 | −88 | −84 | 5 | ○ | ○ |
| EX* 4 | 90.4 | −93 | −90 | 3 | ○ | Δ |
| EX* 5 | 80 | −92 | −87 | 5 | ○ | ○ |
| EX* 6 | 86 | −92 | −88 | 4 | ○ | ○ |
| EX* 7 | 88 | −94 | −92 | 2 | ○ | ○ |
| EX* 8 | 81 | −92 | −86 | 7 | ○ | ○ |
| EX* 9 | 89 | −94 | −92 | 2 | ○ | Δ |
| EX* 10 | 74 | −88 | −64 | 27 | X | ○ |
| EX* 11 | 72 | −87 | −68 | 22 | X | ○ |
| EX* 12 | 104 | −99 | −96 | 3 | ○ | X |

IM*: immediately after
1-week*: after one week
R/C*: rate of change
C/S*: charge stability
D/S*: developing speed
EX*: experimental sample According to the above results, the liquid developers of the experimental examples 1–9, each of which contained the carrier liquid having the aniline point in a range from 80° C. to 100° C., achieved the toner charge stability and the developing speed, which can be evaluated as good or relatively good, and are in the allowed range. According to the experimental examples 10 and 11, the toner had bad charge stability. The reason for this can be considered that the carrier liquid had a low aniline point lower than 80° C., and therefore the yellow color agent in the toner dissolved in the carrier liquid. In the experimental example 12, the developing speed was bad. The reason for this can be considered that the carrier liquid had the high aniline point exceeding 100° C., and therefore had an excessively high viscosity. In the experimental examples 4 and 9, the aniline points are relatively high and are 90.4° C. and 89° C., respectively, so that the developing speeds are not fully good.

From the results, it can be understood that the first liquid developer can provide a practically sufficient developing speed, can suppress lowering of the chargeability of toner over time as well as lowering of the electric resistance value of the carrier liquid over time, which may be caused by ingredients dissolved in the carrier liquid, and thereby can suppress disadvantages such as lowering of the developing speed, disadvantageous change in image density, image failures such as blur and loss of images, and condensation of the toner during preservation.

(2) Second Liquid Developer

In a second electrophotographic liquid developer, toner is dispersed in electrically insulating carrier liquid. The toner contains, as an additive, a charge control agent which is at least one of salicylic acid metal salt; and derivatives thereof. The carrier liquid has the aniline point from 80° C. to 100° C.

The charge control agent is added into the toner and/or onto the surface of the toner, and cooperates with a charge director, which is added to the carrier liquid and will be described later, to provide a high chargeability to the toner. The charge control agent added to the toner does not substantially dissolve in the carrier liquid.

In this second electrophotographic liquid developer, the toner contains at least one compound selected from among the salicylic acid metal salt and derivatives thereof.

According to the second electrophotographic liquid developer, since the toner contains, as the charge control agent, the salicylic acid metal salt and/or derivative(s) thereof (which will be generally referred to as "salicylic acid metal salt or the like" hereinafter), the toner has a high chargeability so that fast developing can be performed.

For achieving the high chargeability of the toner, the prior art employs the charge director applied to carrier liquid, and further may employ, for example, a binder resin, which has a polar group introduced thereinto, and thereby has the chargeability in itself, and/or a coloring agent which can provide the chargeability in the toner. In this second developer, however, the toner contains the salicylic acid metal salt or the like, and thereby can have a high chargeability so that the binder resin and the coloring agent can be selected from a wide range.

Since the liquid having the aniline point of 80° C. or more is used as the carrier liquid, the salicylic acid metal salt or the like contained in the toner is prevented from dissolving in the carrier liquid. Thereby, it is possible to suppress lowering of the toner chargeability as well as lowering of the electric resistance value of the carrier liquid, which may be caused by ingredients dissolved in the carrier liquid, and it is possible to suppress disadvantages such as lowering of the developing speed, disadvantageous change in image density, image failures such as blur and loss of images, and condensation of the toner during preservation. The aniline point of the carrier liquid does not exceed 100° C. for the following reason. Among solvents of homologous series, the solvent having a higher aniline point has a larger molecular weight and therefore a higher viscosity. Therefore, by determining the upper limit of the aniline point, it is possible to prevent lowering of the developing speed which may be caused by rise in viscosity of the carrier liquid. More preferably, the aniline point of the carrier liquid is in a range from 80° C. to 90° C.

The second liquid developer can be manufactured, for example, by the following manner.

First, the binder resin, charge control agent (salicylic acid metal salt or the like) and coloring agent are kneaded, e.g., by a three-roll kneader so that the salicylic acid metal salt or the like and the coloring agent are dispersed in the resin.

The salicylic acid metal salt or its derivative which is usable as charge control agent (CCA) in the second liquid developer is generally represented by the following formula:

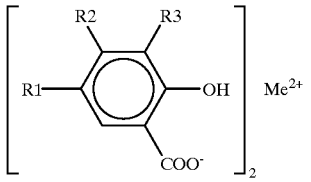

wherein R1, R2 and R3 are hydrogen atom, alkyl having 1 to 10 carbon atoms or aryl. Preferable is hydrogen atom, alkyl having 1 to 6 carbon atoms or aryl. Examples of metals (Me) are zinc, nickel, cobalt, lead and chromium. These are used singly or a combination of at least two of them.

Especially preferable is a zinc salt of salicylic acid wherein R1, R3=tert.-butyl, R2=hydrogen atom and Me=Zinc, e.g., Bontron E84 (Orient Kagaku Co., Ltd.), which is a solid derivative of colorless and high safety.

The addition rate of the salicylic acid metal salt or the like to the binder resin is preferably in a range from about 0.01 wt % to about 30 wt % for achieving appropriate chargeability and thermal resistance of the whole liquid developer as well as stiffness and others of the final image. More preferably, this rate is substantially in a range from 0.1 wt % to 10 wt %. By adjusting the addition rate of the salicylic acid metal salt or the like, the quantity of charges on the toner can be controlled.

The salicylic acid metal salt or the like may be forcedly adhered or absorbed onto the surface of toner instead of the manner in which it is kneaded together with the binder resin and thereby is contained in the toner. The salicylic acid metal salt or the like can be adhered or absorbed onto the toner surface in such a manner that the salicylic acid metal salt or the like is added into the carrier liquid in the step of wet-crushing the toner rough particles in the carrier liquid for finally producing the toner particles of the predetermined particle diameter, or that the salicylic acid metal salt or the like is added to the produced liquid developer and wet-crushing is performed for a short time.

The coloring agent may be a coloring agent which has an insufficient negative chargeability, and therefore cannot be used in the prior art. The pigment is more preferable than the dye in view of the cost, resistance to light, colorability and others. Examples of such a pigment are as follows.

Carbon black is a typical example of the pigment for black. Yellow, magenta or cyan pigments may be used as color pigments other than black. Color image formation is performed by subtractive color mixture based on these pigment colors. The yellow pigment may be a disazo yellow pigment or the like such as Color Index (C. I.) pigment Yellow 12, 13, 14, 17, 55, 81, 83 or 180. The magenta pigment may be an azolake magenta pigment such as C. I. Pigment Red 48, 57 (Carmin 6B), 5, 23, 60, 114, 146 or 186, an insoluble azo-magenta pigment, a thio-indigo magenta pigment, or a quinacridon magenta pigment such as C. I. Pigment Red 122 or 209. The cyan pigment may be, e.g., a copper phthalocyanine blue cyan pigment such as C. I. Pigment Blue 15:1 or 15:3.

The addition rate of the coloring agent with respect to the binder resin is preferably 5 through 20 weight parts with respect to 100 weight parts of the resin. A resin which is colored in itself may be employed.

The binder resin forming the toner particles may be similar to the binder resin of the toner which is already described in connection with the first liquid developer. The thermoplastic saturated polyester resin and ethylenic copolymer are typical examples.

Then, the coloring mixture formed of the binder resin, salicylic acid metal salt or the like, coloring agent and others is roughly crushed by the cutter mill, jet mill or the like, and the wet grinding is effected on the crushed rough toner in a small amount of carrier liquid containing the dissolved charge director. Thereby, the mixture is finely crushed so that the toner substantially has a particle diameter in a range from 0.1 $\mu$m to 10 $\mu$m, and more preferably in a range from 0.5 $\mu$m to 5 $\mu$m, and thereby the high-concentration liquid developer is produced. The high-concentration liquid developer produced in this manner is diluted, if necessary, with the carrier liquid containing the charge director to achieve an appropriate toner concentration.

The carrier liquid has a resistance value in a range from about $10^{11}$ to $10^{16}$ $\Omega$·cm which does not disturb the electrostatic latent image. The carrier liquid at the room temperature may be in any state provided that the carrier liquid is in the liquid state when it is heated to a temperature higher than the softening point of the dispersed resin in the developing operation. Preferably, it also has a boiling point which allows easy drying after the fixing process. Further, it is preferable that the solvent emits no foul odor, is nonpoisonous and has a relatively low inflammation point.

The second liquid developer can employ the same carrier liquid as that of the first liquid developer already described. However, the solvent having the aniline point from 80° C. to 100° C., and preferably from 80° C. to 90° C. is used as the carrier liquid.

The carrier liquid having the aniline point in the above range can be formed using a single kind of solvent selected from the hydrocarbon solvents already described in connection with the first liquid developer, or a combination of two or more of them. Among the hydrocarbon solvents, the above conditions are satisfied by 0 grade Solvent L, 0 grade Solvent M, 0 grade Solvent H, Isoper G, Isoper H, Isoper L, Isoper M, IP Solvent 1620, IP Solvent 2028 and others. In particular, it is preferable to use 0 grade Solvent L, 0 grade Solvent M, Isoper G, Isoper H, Isoper L or IP Solvent 1620.

The charge director is substantially solvated or dissolved in the carrier liquid, and is added for the purpose of affecting the quantity of charges of the toner particles. If necessary, the charge director may be added into the toner particles.

The charge director may be the same as that in the first liquid developer already described.

The charge director may be formed of a single kind of agent or a mixture of two or more kinds of agents. Depending on the intended chargeability, the charge director may be added at a rate from 0.01 wt % to 100 wt % with respect to the toner.

A dispersant (dispersion stabilizer) may be used for stabilizing dispersion of the toner particles in the liquid developer. This dispersant (dispersion stabilizer) may be the same as that already described in connection with the first liquid developer.

The dispersant is preferably added to the carrier liquid at the rate from 0.01 wt % to 20 wt % for improving the dispersibility and preventing rise in viscosity of the carrier liquid due to addition of the dispersant. More preferably, the rate is substantially in a range from 0.1 wt % to 10 wt %.

A rate of the total weight of the solid components such as the toner, charge director and dispersant with respect to the total weight of the liquid developer is preferably in a range from about 1 wt % to 90 wt %. For the purpose of reducing the total amount of the liquid developer used for the developing, and thereby facilitating the handling, the total rate of the solid components is more preferably in a range from 2 wt % to 50 wt %.

Specific examples of the electrophotographic second liquid developer will now be described below. The second liquid developer according to the invention is not restricted to the following developers.

Manufacturing of the Binder Resin (1) A polyester resin used as a binder resin in experimental examples, which will be described later, was produced in the same manner as that in the first liquid developer.

The polyester resin thus formed was 6500 in Mw, 2500 in Mn, 55.1° C. in Tg and 25.0 mgKOH/g in acid value.

(2) As an ethylenic resin was used a thermoplastic ethylene/ethyl acrylate resin ELVACITE (E. I. duPont de Nemours and company).

Experimental examples of manufacturing of the liquid developer are as follows.

EXPERIMENTAL EXAMPLE 13

A mixture of 60 parts of the polyester resin and 40 parts of carbon black Morgal L (manufactured by Cyabot Co., Ltd.) was kneaded at 180° C. for four hours by a kneader with three rolls, and thereby a high-concentration pigment mixture was prepared. This high-concentration pigment mixture and the foregoing polyester resin were crushed with a feathering mill. The crushed material and a salicylic acid zinc salt derivative E84 were mixed together by a Henschel mixer, and the mixture thus prepared was kneaded by a 2-shaft extruder/kneader to produce finally the coloring resin mixture including the carbon black at 15 wt % and E84 at 3 wt %. The coloring resin mixture was sufficiently cooled, and then was roughly crushed by a cutter mill. Thereafter, the mixture was finely crushed by a jet mill (Nippon Pneumatic Kogyo Co., Ltd.) to produce coloring toner rough particles having an average particle diameter of about 10 μm. Thirty grams of the coloring toner rough particles were mixed with 70 grams of 0 grade solvent L (aniline point of 80.4° C.) containing 0.5 wt % of barium salt of petroleum sulfonic acid Sulfol Ba-30N (Matsumura Oil Reseach Corp.). Wet grinding was effected on this mixture by performing processing for 15 hours with a sand grinder (IGARASHI KIKAI SEIZO Co., Ltd.), a media formed of 150 cc of glass beads having a diameter of 1 mm, a ⅛-gallon vessel with water-jacket, a cooling water temperature of 20° C. and a disk rotation speed of 2000 rpm. In this manner, the high-concentration liquid developer having a volume average toner particle diameter of 1.52 μm was prepared.

The high-concentration liquid developer was diluted by adding 900 parts of 0 grade Solvent L solution containing 0.5 wt % of Sulfol Ba-30N to 100 parts of the above high-concentration liquid developer. Dispersing processing was effected on this mixture by a dispersing device T. K. autohomomixer M-type (Tokushu Kikai Kogyo Co., Ltd.) with 10000 rpm for 5 minutes. Thereby, the liquid developer 13 was produced.

EXPERIMENTAL EXAMPLE 14

A liquid developer 14 was produced in the same manner as the experimental example 13 except for that the ethylene/ethyl acrylate was used instead of the polyester resin as the binder resin.

EXPERIMENTAL EXAMPLE 15

A liquid developer 15 was produced in the same manner as the experimental example 13 except for that D grade Solvent H (aniline point of 90.4° C.) was used instead of 0 grade Solvent L (aniline point of 80.4° C.) as the carrier liquid.

EXPERIMENTAL EXAMPLE 16

A liquid developer 16 was produced in the same manner as the experimental example 13 except for that Isoper G (aniline point of 80° C.) was used instead of 0 grade Solvent L (aniline point of 80.40° C.) as the carrier liquid.

EXPERIMENTAL EXAMPLE 17

A liquid developer 17 was produced in the same manner as the experimental example 13 except for that Isoper L (aniline point of 86° C.) was used instead of 0 grade Solvent L (aniline point of 80.4° C.) as the carrier liquid.

EXPERIMENTAL EXAMPLE 18

A liquid developer 18 was produced in the same manner as the experimental example 13 except for that Isoper M (aniline point of 88° C.) was used instead of 0 grade Solvent L (aniline point of 80.4° C.) as the carrier liquid.

EXPERIMENTAL EXAMPLE 19

A liquid developer 19 was produced in the same manner as the experimental example 13 except for that IP Solvent 1620 (aniline point of 81° C.) was used instead of 0 grade Solvent L (aniline point of 80.4° C.) as the carrier liquid.

EXPERIMENTAL EXAMPLE 20

A liquid developer 20 was produced in the same manner as the experimental example 13 except for that IP Solvent 2028 (aniline point of 89° C.) was used instead of 0 grade Solvent L (aniline point of 80.4° C.) as the carrier liquid.

EXPERIMENTAL EXAMPLE 21

A liquid developer 21 was produced in the same manner as the experimental example 13 except for that the charge control agent E84 was not added.

EXPERIMENTAL EXAMPLE 22

A liquid developer 22 was produced in the same manner as the experimental example 13 except for that Isoper E (aniline point of 74° C.) was used instead of 0 grade Solvent L (aniline point of 80.4° C.) as the carrier liquid.

EXPERIMENTAL EXAMPLE 23

A liquid developer 23 was produced in the same manner as the experimental example 13 except for that IP Solvent 1016 (aniline point of 72° C.) was used instead of 0 grade Solvent L (aniline point of 80.4° C.) as the carrier liquid.

EXPERIMENTAL EXAMPLE 24

A liquid developer 24 was produced in the same manner as the experimental example 13 except for that IP Solvent 2835 (aniline point of 104° C.) was used instead of 0 grade Solvent L (aniline point of 80.4° C.) as the carrier liquid.

Then, description will be given on evaluation which was made on the liquid developers 13–24, and particularly on the charge stability of the toner and the developing speed.

The charge stability was evaluated by measuring changes in zeta potential (ζ-potential) of the liquid developer over time, similarly to the case of the experimental examples 1 to 12 relating to the first liquid developer already described.

The zeta potential of each liquid developer was measured immediately after the production and after being kept at the room temperature for one week, and was evaluated on the same basis as the experimental examples 1 to 12.

The developing speed was evaluated by the actual image forming tests using the respective liquid developers and the image forming apparatus, of which schematic structure is shown in FIG. 1.

The evaluation of the developing speed with the apparatus shown in FIG. 1 was performed in the same manner and on the same bases as those of the experimental examples of the first liquid developer.

The following list shows the results of evaluation of the toner charge stability and the developing speed of the respective liquid developers.

| | Aniline Point | | Zeta Potential | | | Evaluation | |
|---|---|---|---|---|---|---|---|
| | | | IM* | 1-week* | R/C* | | |
| | (° C.) | E84 | (mV) | (mV) | (%) | C/S* | D/S* |
| EX* 13 | 80.4 | Y* | −144 | −138 | 4 | ○ | ○ |
| EX* 14 | 80.4 | Y* | −140 | −135 | 4 | ○ | ○ |
| EX* 15 | 90.4 | Y* | −149 | −146 | 2 | ○ | Δ |
| EX* 16 | 80 | Y* | −140 | −123 | 12 | Δ | ○ |
| EX* 17 | 86 | Y* | −148 | −142 | 4 | ○ | ○ |
| EX* 18 | 88 | Y* | −150 | −146 | 3 | ○ | Δ |

-continued

| | Aniline Point (° C.) | E84 | Zeta Potential IM* (mV) | 1-week* (mV) | R/C* (%) | Evaluation C/S* | D/S* |
|---|---|---|---|---|---|---|---|
| EX* 19 | 81 | Y* | −140 | −130 | 7 | ○ | ○ |
| EX* 20 | 89 | Y* | −149 | −146 | 2 | ○ | Δ |
| EX* 21 | 80.4 | N* | −80 | −78 | 1 | ○ | X |
| EX* 22 | 74 | Y* | −136 | −101 | 26 | X | ○ |
| EX* 23 | 72 | Y* | −136 | −100 | 26 | X | ○ |
| EX* 24 | 104 | Y* | −149 | −147 | 1 | ○ | X |

IM*: immediately after
1-week*: after one week
R/C*: rate of change
C/S*: charge stability
D/S*: developing speed
EX*: experimental example
Y*: E84 is added.
N*: E84 is not added.

According to the above results, it can be understood that the liquid developers of the experimental examples 13–20, each of which contained E84 as the charge control agent, and also contained the carrier liquid having the aniline point in a range from 80° C. to 100° C., achieved the toner chargeability which was high and relatively stable. The liquid developers of the experimental examples 13 to 20 had the developing speed, which can be evaluated as (good or relatively good, and is in the allowed range. According to the experimental example 21, the toner had a low chargeability and achieved an insufficient developing speed. The reason for this can be considered that E84 was not added. According to the experimental examples 22 and 23, the toner had bad charge stability. The reason for this can be considered that the carrier liquid had a low aniline point lower than 80° C., and therefore E84 in the toner dissolved in the carrier liquid. In the experimental example 24, the developing speed was bad although the toner had the high chargeability. The reason for this can be considered that the carrier liquid had the excessively high aniline point exceeding 100° C., and therefore had an excessively high viscosity.

From the results, it can be understood that the second liquid developer includes the toner having a high chargeability, can provide a practically sufficient developing speed, can suppress lowering of the chargeability of toner over time as well as lowering of the electric resistance value of the carrier liquid over time, which may be caused by ingredients dissolved in the carrier liquid, and thereby can suppress disadvantages such as lowering of the developing speed, disadvantageous change in image density, image failures such as blur and loss of images, and condensation of the toner during preservation.

(3) Third Liquid Developer

In a third electrophotographic liquid developer, toner is dispersed in electrically insulating carrier liquid. The toner contains, as an additive, a charge control agent which is at least one compound selected from among borate-containing compound and derivatives thereof. The carrier liquid has the aniline point from 80° C. to 100° C.

The third developer contains at least one compound selected from among borate-containing compound and derivatives thereof.

According to the third liquid developer, since the toner contains, as the charge control agent, the borate-containing compound and/or derivative(s) thereof (which will be generally referred to as "borate-containing compound or the like" hereinafter), the toner has a high chargeability so that fast developing can be performed.

For achieving the high chargeability of the toner, the prior art employs the charge director applied to carrier liquid, and further may employ, for example, a binder resin, which has a polar group introduced thereinto and thereby has the chargeability in itself, and/or a coloring agent which can provide the chargeability in the toner. In this third developer, however, the toner contains the borate-containing compound or the like, and thereby can have a high chargeability so that the binder resin and the coloring agent can be selected from a wide range.

Since the liquid having the aniline point of 80° C. or more is used as the carrier liquid, the borate-containing compound or the like contained in the toner is prevented from dissolving in the carrier liquid. Thereby, it is possible to suppress lowering of the chargeability as well as lowering of the electric resistance value of the carrier liquid, which may be caused by ingredients dissolved in the carrier liquid, and it is possible to suppress disadvantages such as lowering of the developing speed, disadvantageous change in image density, image failures such as blur and loss of images, and condensation of the toner during preservation. The aniline point of the carrier liquid does not exceed 100° C. for the following reason. Among solvents of homologous series, the solvent having a higher aniline point has a larger molecular weight and therefore a higher viscosity. Therefore, by determining the upper limit of the aniline point, it is possible to prevent lowering of the developing speed which may be caused by rise in viscosity of the carrier liquid. More preferably, the aniline point of the carrier liquid is in a range from 80° C. to 90° C.

The third liquid developer can be manufactured, for example, by the following manner.

First, the binder resin, charge control agent (borate-containing compound or the like) and coloring agent are kneaded, e.g., by a three-roll kneader so that the borate-containing compound or the like and the coloring agent are dispersed in the resin.

One kind of borate-containing compound or its derivative can be used solely or in combination with another kind of borate-containing compound or its derivative. The borate-containing compound or the like which is usable as CCA in the third liquid developer may be the same as those disclosed, e.g., in Japanese Laid-Open Patent Publication No. 8-10361, and particularly the compound represented by the following formula is preferable.

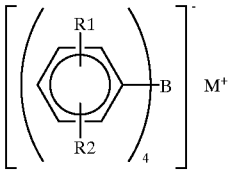

wherein R1 is hydrogen atom, halogen atom, lower alkyl or halomethyl, R2 is hydrogen atom or halomethyl, $M^+$ is selected from among metal cations; ammonium, alkylammonium, pyridinium, quinolinium, imidazolinium or like organic amine cations; sulfonium cations; and phosphonium cations.

Especially, a compound (potassium borobisbenzilate manufactured by Orient Kagaku Co., Ltd., LR147) expressed by the following formula is preferable, because it is a colorless solid compound having high safety.

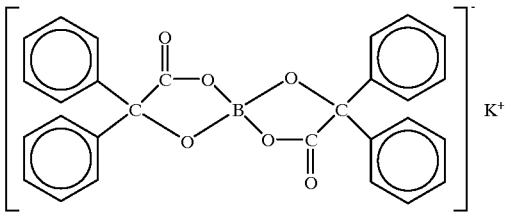

The addition rate of the borate-containing compound or the like to the binder resin is preferably in a range from about 0.01 wt % to about 30 wt % for achieving appropriate chargeability and thermal resistance of the whole liquid developer as well as stiffness and others of the final image. More preferably, this rate is substantially in a range from 0.1 wt % to 10 wt %. By adjusting the addition rate of the borate-containing compound or the like, the quantity of charges on the toner can be controlled.

The borate-containing compound or the like may be forcedly adhered or absorbed onto the surface of toner instead of the manner in which it is kneaded together with the binder resin and thereby is contained in the toner. The borate-containing compound or the like can be adhered or absorbed onto the toner surface in such a manner that the borate-containing compound or the like is added into the carrier liquid in the step of wet-crushing the toner rough particles in the carrier liquid for finally producing the toner particles of the predetermined particle diameter, or that the borate-containing compound or the like is added to the produced liquid developer and wet-crushing is performed for a short time.

The coloring agent may be a coloring agent which has an insufficient negative chargeability, and therefore cannot be used in the prior art. The pigment is more preferable than the dye in view of the cost, resistance to light, colorability and others. The third liquid developer can employ the carbon black and other pigment, which can be employed in the second liquid developer as described before.

The addition rate of the coloring agent with respect to the binder resin is preferably 5 through 20 weight parts with respect to 100 weight parts of the resin. A resin which is colored in itself may be employed.

The binder resin forming the toner particles may be similar to the binder resin of the toner which is already described in connection with the first liquid developer. The thermoplastic saturated polyester resin and ethylenic copolymer are typical examples.

Then, the coloring mixture formed of the binder resin, borate-containing compound or the like, coloring agent and others is roughly crushed by the cutter mill, jet mill or the like, and the wet grinding is effected on the crushed rough toner in a small amount of carrier liquid containing the dissolved charge director. Thereby, the mixture is finely crushed so that the toner substantially has a particle diameter in a range from 0.1 $\mu$m to 10 $\mu$m, and more preferably in a range from 0.5 $\mu$m to 5 $\mu$m, and thereby the high-concentration liquid developer is produced. The high-concentration liquid developer produced in this manner is diluted, if necessary, with the carrier liquid containing the charge director to achieve an appropriate toner concentration.

The carrier liquid has a resistance value in a range from about $10^{11}$ to $10^{16}$ $\Omega$·cm which does not disturb the electrostatic latent image. The carrier liquid at the room temperature may be in any state provided that the carrier liquid is in the liquid state when it is heated to a temperature higher than the softening point of the dispersed resin in the developing operation. Preferably, it also has a boiling point which allows easy drying after the fixing process. Further, it is preferable that the solvent emits no foul odor, is nonpoisonous and has a relatively low inflammation point.

The third liquid developer can employ the same carrier liquid as that of the first liquid developer already described. In the third liquid developer, however, the solvent having the aniline point from 80° C. to 100° C., and preferably from 80° C. to 90° C. is used as the carrier liquid.

The carrier liquid having the aniline point in the above range can be formed using a single kind of solvent selected from the hydrocarbon solvents already described in connection with the first liquid developer, or a combination of two or more of them. Among the hydrocarbon solvents, the above conditions are satisfied by 0 grade Solvent L, 0 grade Solvent M, 0 grade Solvent H, Isoper G, Isoper H, Isoper L, Isoper M, IP Solvent 1620, IP Solvent 2028 and others. In particular, it is preferable to use 0 grade Solvent L, 0 grade Solvent M, Isoper G, Isoper H, Isoper L or IP Solvent 1620.

As already described, the charge director is substantially solvated or dissolved in the carrier liquid, and is added for the purpose of affecting the quantity of charges of the toner particles. If necessary, the charge director may be added into the toner particles.

The charge director may be the same as that in the first liquid developer.

The charge director may be formed of a single kind of agent or a mixture of two or more kinds of agents. Depending on the intended chargeability, the charge director may be added at a rate from 0.01 wt % to 100 wt % with respect to the toner.

A dispersant (dispersion stabilizer) may be used for stabilizing dispersion of the toner particles in the liquid developer. This dispersant (dispersion stabilizer) may be the same as that already described in connection with the first liquid developer.

The dispersant is preferably added to the carrier liquid at the rate from 0.01 wt % to 20 wt % for improving the dispersibility and preventing rise in viscosity of the carrier liquid due to addition of the dispersant. More preferably, the rate is substantially in a range from 0.1 wt %; to 10 wt %.

A rate of the total weight of the solid components such as the toner, charge director and dispersant with respect to the total weight of the liquid developer is preferably in a range from about 1 wt % to 90 wt %. For the purpose of reducing the total amount of the liquid developer used for the developing, and thereby facilitating the handling, the total rate of the solid components is more preferably in a range from 2 wt % to 50 wt %.

Specific examples of the third liquid developer will now be described below. The third liquid developer according to the invention is not restricted to the following developers.

Manufacturing of the Binder Resin (1) A thermoplastic saturated polyester resin used as a binder resin in experimental examples, which will be described later, was produced in the same manner as that in the first liquid developer.

The polyester resin thus formed was 6500 in Mw, 2500 in Mn, 55.1° C. in Tg and 25.0 mgKOH/g in acid value.

(2) As an ethylenic resin was used a thermoplastic ethylene/ethyl acrylate resin ELVACITE (E. I. duPont de Nemours and Company).

Experimental examples of manufacturing of the third liquid developer are as follows.

EXPERIMENTAL EXAMPLE 25

A mixture of 60 parts of the polyester resin and 40 parts of carbon black Morgal L (manufactured by Cyabot Co., Ltd.) was kneaded at 180° C. for four hours by a kneader with three rolls, and thereby a high-concentration pigment mixture was prepared. This high-concentration pigment mixture and the foregoing polyester resin were crushed with a feathering mill. The crushed material and a borate-containing compound LR147 were mixed together by a Henschel mixer, and the mixture thus prepared was kneaded by a 2-shaft extruder/kneader to produce finally the coloring resin mixture including the carbon black at 15 wt % and LR147 at 3 wt %. The coloring resin mixture was sufficiently cooled, and then was roughly crushed by a cutter mill. Thereafter, the mixture was finely crushed by a jet mill (Nippon Pneumatic Kogyo Co., Ltd.) to produce coloring toner rough particles having an average particle diameter of about 10 μm. Thirty grams of the coloring toner rough particles were mixed with 70 grams of 0 grade solvent L (aniline point of 80.4° C.) containing 0.5 wt % of barium salt of petroleum sulfonic acid Sulfol Ba-30N (Matsumura Oil Research Corp.). Wet grinding was effected on this mixture by performing processing for 15 hours with a sand grinder (IGARASHI KIKAI SEIZO Co., Ltd.), a media formed of 150 cc of glass beads having a diameter of 1 mm, a ⅛-gallon vessel with water-jacket, a cooling water temperature of 20° C. and a disk rotation speed of 2000 rpm. In this manner, the high-concentration liquid developer having a volume average toner particle diameter of 1.46 μm was prepared.

The high-concentration liquid developer was diluted by adding 900 parts of 0 grade Solvent L solution containing 0.5 wt % of Sulfol Ba-30N to 100 parts of the above high-concentration liquid developer. Dispersing processing was effected on this mixture by a dispersing device T. K. autohomomixer M-type (Tokushu Kikai Kogyo Co., Ltd.) with 10000 rpm for 5 minutes. Thereby, the liquid developer 25 was produced.

EXPERIMENTAL EXAMPLE 26

A liquid developer 26 was produced in the same manner as the experimental example 25 except for that the ethylene/ethyl acrylate was used instead of the polyester resin as the binder resin.

EXPERIMENTAL EXAMPLE 27

A liquid developer 27 was produced in :he same manner as the experimental example 25 except for that 0 grade Solvent H (aniline point of 90.4° C.) was used instead of 0 grade Solvent L (aniline point of 80.4° C.) as the carrier liquid.

EXPERIMENTAL EXAMPLE 28

A liquid developer 28 was produced in the same manner as the experimental example 25 except for that Isoper G (aniline point of 80° C.) was used instead of 0 grade Solvent L (aniline point of 80.4° C.) as the carrier liquid.

EXPERIMENTAL EXAMPLE 29

A liquid developer 29 was produced in the same manner as the experimental example 25 except for that Isoper L (aniline point of 86° C.) was used instead of 0 grade Solvent L (aniline point of 80.4° C.) as the carrier liquid.

EXPERIMENTAL EXAMPLE 30

A liquid developer 30 was produced in the same manner as the experimental example 25 except for that Isoper M (aniline point of 88° C.) was used instead of 0 grade Solvent L (aniline point of 80.4° C.) as the carrier liquid.

EXPERIMENTAL EXAMPLE 31

A liquid developer 31 was produced in the same manner as the experimental example 25 except for that IP Solvent 1620 (aniline point of 81° C.) was used instead of 0 grade Solvent L (aniline point of 80.4° C.) as the carrier liquid.

EXPERIMENTAL EXAMPLE 32

A liquid developer 32 was produced in the same manner as the experimental example 25 except for that IP Solvent 2028 (aniline point of 89° C.) was used instead of 0 grade Solvent L (aniline point of 80.4° C.) as the carrier liquid.

EXPERIMENTAL EXAMPLE 33

A liquid developer 33 was produced in the same manner as the experimental example 25 except for that the charge control agent LR147 was not added.

EXPERIMENTAL EXAMPLE 34

A liquid developer 34 was produced in the same manner as the experimental example 25 except for that Isoper E (aniline point of 74° C.) was used instead of 0 grade Solvent L (aniline point of 80.4° C.) as the carrier liquid.

EXPERIMENTAL EXAMPLE 35

A liquid developer 35 was produced in the same manner as the experimental example 25 except for that IP Solvent 1016 (aniline point of 72° C.) was used instead of 0 grade Solvent L (aniline point of 80.4° C.) as the carrier liquid.

EXPERIMENTAL EXAMPLE 36

A liquid developer 36 was produced in the same manner as the experimental example 25 except for that IP Solvent 2835 (aniline point of 104° C.) was used instead of 0 grade Solvent L (aniline point of 80.4° C.) as the carrier liquid.

Then, description will be given on evaluation which was made on the liquid developers 25–36, and particularly on the charge stability of the toner and the developing speed.

The charge stability was evaluated by measuring changes in zeta potential (ζ-potential) of the liquid developer over time, similarly to the case of the experimental examples 1 to 12 relating to the first liquid developer already described.

The zeta potential of each liquid developer was measured immediately after the production and after being kept at the room temperature for one week, and was measured on the same basis as the experimental examples 1 to 12.

The developing speed was evaluated by the actual image forming tests using the respective liquid developers and the image forming apparatus, of which schematic structure is shown in FIG. 1.

The evaluation of the developing speed with the apparatus shown in FIG. 1 was performed in the same manner and on the same bases as those of the experimental examples of the first liquid developer.

The following list shows the results of evaluation of the toner charge stability and the developing speed of the respective liquid developers.

| | Aniline Point (° C.) | LR147 | Zeta Potential IM* (mV) | Zeta Potential 1-week* (mV) | Zeta Potential R/C* (%) | Evaluation C/S* | Evaluation D/S* |
|---|---|---|---|---|---|---|---|
| EX* 25 | 80.4 | Y* | −134 | −127 | 5 | ○ | ○ |
| EX* 26 | 80.4 | Y* | −130 | −126 | 4 | ○ | ○ |
| EX* 27 | 90.4 | Y* | −139 | −135 | 3 | ○ | Δ |
| EX* 28 | 80 | Y* | −130 | −114 | 13 | Δ | ○ |
| EX* 29 | 86 | Y* | −138 | −131 | 5 | ○ | ○ |
| EX* 30 | 88 | Y* | −140 | −135 | 3 | ○ | Δ |
| EX* 31 | 81 | Y* | −130 | −122 | 6 | ○ | ○ |
| EX* 32 | 89 | Y* | −139 | −135 | 3 | ○ | Δ |
| EX* 33 | 80.4 | N* | −80 | −78 | 3 | ○ | X |
| EX* 34 | 74 | Y* | −127 | −93 | 26 | X | ○ |
| EX* 35 | 72 | Y* | −127 | −91 | 28 | X | ○ |
| EX* 36 | 104 | Y* | −139 | −136 | 2 | ○ | X |

IM*: immediately after
1-week*: after one week
R/C*: rate of change
C/S*: charge stability
D/S*: devloping speed
EX*: experimental example
Y*: LR147 is added.
N*: LR147 is not added.

According to the above results, it can be understood that the liquid developers of the experimental examples 25–32, each of which contained LR147 as the charge control agent, and also contained the carrier liquid having the aniline point in a range from 80° C. to 100° C., achieved the toner chargeability which was high and relatively stable. The liquid developers of the experimental examples 25 to 32 had the developing speed, which can be evaluated as good or relatively good, and is in the allowed range. According to the experimental example 33, the toner had a low chargeability and achieved an insufficient developing speed. The reason for this can be considered that LR147 was not added. According to the experimental examples 34 and 35, the toner had bad charge stability. The reason for this can be considered that the carrier liquid had a low aniline point lower than 80° C., and therefore LR147 in the toner dissolved in the carrier liquid. In the experimental example 36, the developing speed was bad although the toner had the high chargeability. The reason for this can be considered that the carrier liquid had the excessively high aniline point exceeding 100° C., and therefore had an excessively high viscosity.

From the results, it can be understood that the third liquid developer includes the toner having a high chargeability, can provide a practically sufficient developing speed, can suppress lowering of the chargeability of toner over time as well as lowering of the electric resistance value of the carrier liquid over time, which may be caused by ingredients dissolved in the carrier liquid, and thereby can suppress disadvantages such as lowering of the developing speed, disadvantageous change in image density, image failures such as blur and loss of images, and condensation of the toner during preservation.

(4) Fourth Liquid Developer

In a fourth electrophotographic liquid developer, toner is dispersed in electrically insulating carrier liquid. The liquid developer also includes, as the charge director, at least one compound selected from among an oil-soluble ionic surfactant having alkyl group(s) of at least 20 carbon atoms, and a copolymer of a monomer having a nitrogen-containing group and a long-chain (meth)acrylate. The toner contains, as a coloring agent, at least one kind of compound selected from among Color Index Pigment Yellow 180 (PY180), Color Index Solvent Yellow 162 (SY162) and the derivatives thereof.

In the fourth liquid developer, the coloring agent for the yellow toner is formed of the compound classified as PY180, the compound classified as SY162 or the like, each of which does not contain organically bonded chlorine and heavy metal. Therefore, the liquid developer does not adversely affect the environment and others, and is safe. Since these coloring agents have good coloring properties, beautiful colors can be achieved in a full-color image.

As the charge director, the developer includes the oil-soluble ionic surfactant having alkyl group(s) of at least 20 carbon atoms, and/or the copolymer of the monomer having the nitrogen-containing group and the long-chain (meth) acrylate. Therefore, good mutual reaction can be achieved between the toner and the charge director so that the toner chargeability can be high.

The fourth liquid developer can be manufactured, for example, by the following manner.

First, the binder resin and the coloring agent are kneaded so that the coloring agent is dispersed in the resin.

One or more of the compound classified as PY180, the compound classified as SY162 and derivatives thereof is used as the coloring agent. More specifically, Novoperum-Gelb P-HG, Toner Yellow HG VP2155 or the like may be used as PY180, and Neopen Yellow 075 or the like may be used as SY162. These coloring agents may be added at a rate in a range from 3 wt % to 30 wt % with respect to the binder resin, although the specific rate depends on a particular use, a thickness of the toner layer and others. Preferably, the rate is substantially in a range from 5 wt % to 20 wt %. If the addition rate of coloring agent with respect to the binder resin were smaller than 3 wt %, sufficient coloring might not be achieved. If the addition rate of coloring agent with respect to the binder resin were larger than 30 wt %, the coloring agent might not be dispersed sufficiently in the toner, and/or the toner image transferred onto the record member might not be fixed sufficiently by the heat, in which case it would be unavoidable to reduce the fixing speed.

The binder resin forming the toner particles may be similar to the binder resin of the toner which is already described in connection with the first liquid developer. The thermoplastic saturated polyester resin and ethylenic copolymer are typical examples.

Then, the coloring mixture formed of the binder resin, the compound classified as the coloring agent PY180, the compound classified as SY162 or the like, and the charge control agent or the like which are added, if necessary, is roughly crushed by the cutter mill, jet mill or the like, and the wet grinding is effected on the crushed rough toner in a small amount of carrier liquid containing the dissolved charge director. Thereby, the mixture is finely crushed so that the toner substantially has a particle diameter in a range from 0.1 $\mu$m to 10 $\mu$m, and more preferably in a range from 0.5 $\mu$m to 5 $\mu$m, and thereby the high-concentration liquid developer is produced. The high-concentration liquid developer produced in this manner is diluted, if necessary, with the carrier liquid containing the charge director to achieve an appropriate toner concentration.

The carrier liquid has a resistance value in a range from about $10^{11}$ to $10^{16}$ Ω·cm which does not disturb the electrostatic latent image. The carrier liquid at the room temperature may be in any state provided that the carrier liquid is in the liquid state when it is heated to a temperature higher than the softening point of the dispersed resin in the developing operation. Preferably, it also has a boiling point which allows easy drying after the fixing process. Further, it is preferable that the solvent emits no foul odor, is nonpoisonous and has a relatively low inflammation point.

The fourth liquid developer can employ the same carrier liquid as that of the first liquid developer already described. Typically, normal paraffin solvent and iso paraffin solvent can be employed.

As already described, the charge director is substantially solvated or dissolved in the carrier liquid, and is added for the purpose of affecting the quantity of charges of the toner particles. If necessary, the charge director may be added into the toner particles.

The charge director may be the oil-soluble ionic surfactant having alkyl group(s) of at least 20 carbon atoms, and/or the copolymer of the monomer having the nitrogen-containing group and the long-chain (meth)acrylate.

The oil-soluble ionic surfactant having alkyl group(s) of at least 20 carbon atoms may be, e.g., are alkylbenzene-sulfonic acid salt having alkyl group(s) of at least 20 carbon atoms (calcium salt, barium salt, etc.), petroleum sulfonic acid salt [barium salt, calcium salt, magnesium salt, etc., and basic petroleum sulfonic acid salt (barium salt, calcium salt, magnesium salt, etc.)]. Particularly preferable are petroleum sulfonic acid salt [barium salt, calcium salt, and basic petroleum sulfonic acid salt (barium salt, calcium salt)].

Examples of commercially available charge director are Sulfol Ca-45N, Sulfol Ca-45, Sulfol 1040, Molescoamber SC-45N, Molescoamber SC-45, Sulfol Ba-30N, Molescoamber SB-50N (all manufactured by Matsumura Oil Research Corp.), Basic Barium Petronate, Neutral Barium Petronate, Basic Calcium Petronate, Neutral Calcium Petronate, Basic Magnesium Petronate (all manufactured by Witco Chemical Co., Ltd.), and others.

In a copolymer of a monomer having a nitrogen-containing group and a long-chain (meth)acrylate, the long-chain acrylate means a compound obtained by replacing the hydrogen atom of carboxylic group of acrylic acid with hydrocarbon chain having considerably many carbon atoms. The hydrocarbon chain may be linear or cyclic. An example is an acrylate replaced with hydrocarbon chain having nine or more carbon atoms. The long-chain methacrylate means a compound obtained by replacing the hydrogen atom of carboxylic group of methacrylic acid with hydrocarbon chain having considerably many carbon atoms. The hydrocarbon chain may be linear or cyclic. An example is a methacrylate replaced with hydrocarbon chain having ten or more carbon atoms.

Specific examples of copolymers of a monomer having a nitrogen-containing group and a long-chain (meth)acrylate are copolymers of (a) and (b), (a) being at least one of (meth)acrylates having an aliphatic amino group, vinyl monomers having nitrogen-containing heterocyclic ring, cyclic amide monomers having N-vinyl substituent, (meth) acrylamides, aromatic substituted ethylenic monomers having nitrogen-containing group, nitrogen-containing vinyl ether monomers, etc. and (b) being at least one of hexyl (meth)acrylate, cyclohexyl (meth)acrylate, 2-ethylhexyl (meth)acrylate, octyl (meth)acrylate, nonyl (meth)acrylate, decyl (meth)acrylate, dodecyl (meth)acrylate, lauryl (meth) acrylate, stearyl (meth)acrylete, vinyl laurate, vinyl stearate, benzyl (meth)acrylate, pheny (meth)acrylate, etc.

The charge director may be formed of a single kind of agent or a mixture of two or more kinds of agents above described. Depending on the intended chargeability, the charge control agent may be added at a rate from 0.01 wt % to 100 wt % with respect to the toner.

A dispersant (dispersion stabilizer) may be used for stabilizing dispersion of the toner particles in the liquid developer. This dispersant (dispersion stabilizer) may be the same as that already described in connection with the first liquid developer.

The dispersant is preferably added to the carrier liquid at the rate from 0.01 wt % to 20 wt % for improving the dispersibility and preventing rise in viscosity of the carrier liquid due to addition of the dispersant. More preferably, the rate is substantially in a range from 0.1 wt % to 10 wt %.

A rate of the total weight of the solid components such as the toner, charge director and dispersant with respect to the total weight of the liquid developer is preferably in a range from about 1 wt % to 90 wt %. For the purpose of reducing the total amount of the liquid developer used for the developing, and thereby facilitating the handling, the total rate of the solid components is more preferably in a range from 2 wt % to 50 wt %.

Specific examples of the fourth liquid developer will now be described below. The fourth liquid developer according to the invention is not restricted to the following developers.

Manufacturing of the Binder Resin

A thermoplastic saturated polyester resin used as a binder resin in experimental examples, which will be described later, was produced in the same manner as that in the first liquid developer.

The polyester resin thus formed was 6500 in Mw, 2500 in Mn, 55.1° C. in Tg and 25.0 mgKOH/g in acid value.

Experimental examples of manufacturing of the liquid developer are as follows.

EXPERIMENTAL EXAMPLE 37

A mixture of 60 parts of the polyester resin and 40 parts of the yellow coloring agent Toner Yellow HGVP2155 (manufactured by Clariant Co., Ltd.) was kneaded at 180° C. for four hours by a kneader with three rolls, and thereby a high-concentration coloring agent mixture was prepared. This high-concentration coloring agent mixture was diluted with the foregoing polyester resin by a kneader so that the coloring resin mixture containing 15 wt % of PY180 was produced. The coloring resin mixture was sufficiently cooled, and then was roughly crushed by a cutter mill. Thereafter, the mixture was finely crushed by a jet mill (Nippon Pneumatic Kogyo Co., Ltd.) to produce coloring toner rough particles having an average particle diameter of about 10 μm. Thirty grams of the coloring toner rough particles were mixed with 70 grams of 0 grade solvent L (aniline point of 80.4° C.) containing 8 wt % of barium salt of petroleum sulfonic acid Sulfol Ba-30N (Matsumura Oil Reseach Corp.). Wet grinding was effected on this mixture by performing processing for 15 hours with a sand grinder (IGARASHI KIKAI SEIZO Co., Ltd.), a media formed of 150 cc of glass beads having a diameter of 1 mm, a ⅛-gallon vessel with water-jacket, a cooling water temperature of 20° C. and a disk rotation speed of 2000 rpm. In this manner, the high-concentration liquid developer having a volume average toner particle diameter of 1.58 μm was prepared.

The high-concentration liquid developer was diluted by adding 900 parts of 0 grade Solvent L solution containing 0.5 wt % of Sulfol Ba-30N to 100 parts of the above high-concentration liquid developer. Dispersing processing was effected on this mixture by a dispersing device T. K. autohomomixer M-type (Tokushu Kikai Kogyo Co., Ltd.) with 10000 rpm for 5 minutes. Thereby, the liquid developer 37 was produced.

EXPERIMENTAL EXAMPLE 38

A liquid developer 38 was produced in the same manner as the experimental example 37 except for that N-vinyl-2-pyrrolidone/lauryl methacrylate (6/94) copolymer was used instead of the barium salt of petroleum sulfonic acid Sulfol Ba-30N as the charge director.

The N-vinyl-2-pyrrolidone/lauryl methacrylate (6/94) copolymer was prepared in the following manner. In 100 parts of 0-grade Solvent L were placed 47 parts of lauryl methacrylate, 3 parts of N-vinyl-2-pyrrolidone and 0.2 parts of azobisisobutyronitrile (polymerization initiator). The mixture was reacted at 60 to 70° C. for about 12 hours at nitrogen atmosphere.

EXPERIMENTAL EXAMPLE 39

A liquid developer 39 was produced in the same manner as the experimental example 37 except for that Neopen Yellow 075 (SY162) (manufactured by BASF Co., Ltd.) was used instead of Toner Yellow HG VP2155 (PY180) as the coloring agent in the above experimental example 37.

EXPERIMENTAL EXAMPLE 40

A liquid developer 40 was produced in the same manner as the experimental example 37 except for that N-vinyl-2-pyrrolidone/lauryl methacrylate (6/94) copolymer was used instead of barium salt of petroleum sulfonic acid Sulfol Ba-30N as the charge director, and Neopen Yellow 075 (SY162) was used instead of Toner Yellow HG VP2155 (PY180) as the coloring agent in the above experimental embodiment 37.

EXPERIMENTAL EXAMPLE 41

A liquid developer 41 was produced in the same manner as the experimental example 37 except for that barium salt of basic petroleum sulfonic acid Barium Petronate was used instead of barium salt of petroleum sulfonic acid Sulfol Ba-30N as the charge director.

EXPERIMENTAL EXAMPLE 42

A liquid developer 42 was produced in the same manner as the experimental example 37 except for that calcium salt of basic petroleum sulfonic acid Molescoamber SC-45N was used instead of barium salt of petroleum sulfonic acid Sulfol Ba-30N as the charge director.

EXPERIMENTAL EXAMPLE 43

A liquid developer 43 was produced in the same manner as the experimental example 37 except for that calcium salt of basic petroleum sulfonic acid Sulfol 1040 was used instead of barium salt of petroleum sulfonic acid Sulfol Ba-30N as the charge director, and Neopen Yellow 075 (SY162) was used instead of Toner Yellow HG VP2155 (PY180) as the coloring agent in the above experimental example 37.

EXPERIMENTAL EXAMPLE 44

A liquid developer 44 was produced in the same manner as the experimental example 37 except for morpholinoethyl methacrylate/lauryl methacrylate (6/94) copolymer was used instead of barium salt of petroleum sulfonic acid Sulfol Ba-30N as the charge director.

The morpholinoethyl methacrylate/lauryl methacrylate (6/94) copolymer was prepared in the following manner. In 100 parts of O-grade Solvent L were placed 47 parts of lauryl methacrylate, 3 parts of morpholinoethyl methacrylate and 0.2 parts of azobisisobutyronitrile (polymerization initiator). The mixture was reacted at 60 to 70° C. for about 12 hours at nitrogen atmosphere to produce the morpholinoethyl methacrylate/lauryl methacrylate (6/94) copolymer.

EXPERIMENTAL EXAMPLE 45

A liquid developer 45 was produced in the same manner as the experimental example 37 except for that lecithin (amphoteric surfactant) was used instead of barium salt of petroleum sulfonic acid Sulfol Ba-30N as the charge director.

EXPERIMENTAL EXAMPLE 46

A liquid developer 46 was produced in the same manner as the experimental example 39 except for that lecithin (amphoteric surfactant) was used instead of barium salt of petroleum sulfonic acid Sulfol Ba-30N as the charge director.

EXPERIMENTAL EXAMPLE 47

A liquid developer 47 was produced in the same manner as the experimental example 37 except for that aluminium salt of hydrogenated abietic acid (ionic surfactant) was used instead of barium salt of petroleum sulfonic acid Sulfol Ba-30N as the charge director.

EXPERIMENTAL EXAMPLE 48

A liquid developer 48 was produced in the same manner as the experimental example 39 except for that barium salt of dodecylbenzenesulfonic acid (oil-soluble ionic surfactant having 12 carbon atoms) was used instead of barium salt of petroleum sulfonic acid Sulfol Ba-30N as the charge director.

Then, description will be given on evaluation which was made on the liquid developers 37–48, and particularly on the chargeability of the toner and the developing speed.

The chargeability was evaluated by measuring the zeta potential (ζ-potential) of the liquid developer. As already described, the zeta potential in the system, where particles having surface charges are dispersed in the liquid, represents the potential on the electrostatic double layer at the particle surface, and the zeta potential in the liquid developer is a value related to the chargeability of the toner. In the liquid developer having a higher zeta potential, the toner can migrate faster in the carrier liquid, and intended development can be performed in a fast system.

The zeta potential was calculated from the particle speed, which was measured with a zeta potential measuring instrument LAZER ZEE MODEL 501 and a non-aqueous measuring system for PEN KEM 501 (both manufactured by PEN KEM Co., Ltd.) in such a manner that toner particles are subjected to a voltage and thereby migrate, and a laser for observation is emitted to the toner particles for measuring the particle speed. Each sample was prepared by diluting the foregoing liquid developer with 100 parts of 0 grade Solvent L.

The developing speed was evaluated by the actual image forming tests using the respective liquid developers and the image forming apparatus, of which schematic structure is shown in FIG. 1.

The evaluation of the developing speed with the apparatus shown in FIG. 1 was performed in the same manner and on the same bases as those of the experimental examples of the first liquid developer.

The following list shows the results of evaluation of the toner charge stability and the developing speed of the respective liquid developers.

| | Coloring Agent | Charge Director | Zeta Potential (mV) | Developing Speed |
|---|---|---|---|---|
| EX* 37 | PY180 | PSB* | −85 | ○ |
| EX* 38 | PY180 | N2M* | −68 | Δ |
| EX* 39 | SY162 | PSB* | −78 | ○ |
| EX* 40 | SY162 | N2M* | −64 | Δ |
| EX* 41 | PY180 | BSA* | −80 | ○ |
| EX* 42 | PY180 | PSC* | −69 | Δ |
| EX* 43 | SY162 | CSA* | −70 | ○ |
| EX* 44 | PY180 | MMM* | −62 | Δ |
| EX* 45 | PY180 | lecithin | −28 | X |
| EX* 46 | SY162 | lecithin | −23 | X |
| EX* 47 | PY180 | AHA* | −24 | X |
| EX* 48 | SY162 | BDA* | −19 | X |

EX*: experimental example
PSB*: barium salt of petroleum sulfonic acid
N2M*: N-vinyl-2-pyrrolidone/lauryl methacrylate
PSC*: calsium salt of petroleum sulfonic acid
BSA*: barium salt of basic petroleum sulfonic acid
CSA*: calcium salt of basic petroleum sulfonic acid
MMM*: morpholinoethyl methacrylate/lauryl methacrylate
AHA*: aluminium salt of hydrogenated abietic acid
BDA*: barium salt of dodecylbenzenesulfonic acid From the results, it can be understood that relatively high zeta potentials and thereby the developing speeds in good or relatively good ranges can be achieved by the liquid developers of the experimental examples 37 to 44, in which PY180 or SY162 is used as the coloring agent, and the charge director is formed of the oil-soluble ionic surfactant having alkyl group(s) of at least 20 carbon atoms, and/or the copolymer of the monomer having the nitrogen-containing group and the long-chain (meth)acrylate. However, the zeta potential is relatively small, and therefore the developing speed is insufficient according to the experimental examples 45 and 46, in which PY180 or SY162 is used as the coloring agent, and the lecithin (amphoteric surfactant) is used as the charge director. Likewise, the zeta potential is relatively small, and therefore the developing speed is insufficient according to the experimental examples 47 and 48, in which aluminium salt of hydrogenated abietic acid (ionic surfactant) and barium salt of dodecylbenzenesulfonic acid (oil-soluble ionic surfactant having only 12 carbon atoms) are used as the charge directors, respectively.

As a result, it can be understood that the fourth liquid developer can achieve a high toner chargeability and fast developing.

(5) Fifth Liquid Developer

In a fifth electrophotographic liquid developer, toner is dispersed in electrically insulating carrier liquid. The toner includes, as the coloring agent, a compound classified as Color Index Pigment Yellow 180 (PY180) and/or a derivative thereof. The toner has a volume average particle diameter from 0.5 μm to 5 μm.

The volume average particle diameter of the toner can be measured, e.g., with a laser diffraction particle distribution measuring device.

In the fifth electrophotographic liquid developer, the coloring agent for the yellow toner is formed of PY180 or the like, which does not contain organically bonded chlorine and heavy metal. Therefore, the liquid developer does not adversely affect the environment and others, and is safe. Since these coloring agents have good coloring properties, beautiful colors can be achieved in a full-color image.

Since the toner has the volume average particle diameter of 0.5 μm or more, which is larger than the secondary particle diameter of PY180 and others, contents of PY180 or the like in the respective toner particles are substantially uniform so that good final images can be produced without blur and/or loss of color.

The reason for which the toner particles have the volume average particle diameter of 5 μm or less is that an excessively large diameter would impede formation of high-resolution images. The volume average particle diameter of toner is more preferably in a range from 1 μm to 3 μm.

The fifth liquid developer can be manufactured, for example, by the following manner.

First, the melted binder resin and the coloring agent are kneaded so that the coloring agent is dispersed in the resin.

One or more of the compound classified as PY180 and derivatives thereof is used as the coloring agent. More specifically, Novoperum-Gelb P-HG, Toner Yellow HG VP2155 or the like may be used as PY180. These coloring agents may be added at a rate in a range from 3 wt % to 30 wt % with respect to the binder resin, although the specific rate depends on a particular use, a thickness of the toner layer and others. Preferably, the rate is substantially in a range from 5 wt % to 20 wt %. If the addition rate of coloring agent with respect to the binder resin were smaller than 3 wt %, sufficient coloring might not be achieved. If the addition rate of coloring agent with respect to the binder resin were larger than 30 wt %, the coloring agent might not be dispersed sufficiently in the toner, and/or the toner image transferred onto the record member might not be fixed sufficiently by the heat, in which case it would be unavoidable to reduce the fixing speed.

The binder resin forming the toner particles may be similar to the binder resin of the toner which is already described in connection with the first liquid developer. The thermoplastic saturated polyester resin and ethylenic copolymer are typical examples.

Then, the coloring mixture formed of the binder resin, the coloring agent PY180 or the like, and the charge director or the like which are added, if necessary, is, roughly crushed by the cutter mill, jet mill or the like, and the wet grinding is effected on the crushed rough toner in a small amount of carrier liquid containing the dissolved charge director. Thereby, the mixture is finely crushed so that the toner substantially has a particle diameter in a range from 0.5 μm to 5 μm, and more preferably in a range from 1 μm to 3 μm, and thereby the high-concentration liquid developer is produced. The high-concentration liquid developer produced in this manner is diluted, if necessary, with the carrier liquid containing the charge director to achieve an appropriate toner concentration.

The fifth liquid developer can employ the same carrier liquid as that of the first liquid developer already described. Typically, normal paraffin solvent and iso paraffin solvent can be employed.

The charge director may be the same as that of the first liquid developer already described. Preferably, the charge director may be the oil-soluble ionic surfactant such as petroleum sulfonic acid salt [barium salt, calcium salt, magnesium salt, etc., and basic petroleum sulfonic acid salt (barium salt, calcium salt, magnesium salt, etc.)] as described before.

The charge director may be formed of a single kind of agent or a mixture of two or more kinds of agents. Depending on the intended chargeability, the charge control agent may be added at a rate from 0.01 wt % to 100 wt % with respect to the toner.

A dispersant (dispersion stabilizer) may be used for stabilizing dispersion of the toner particles in the liquid developer. This dispersant (dispersion stabilizer) may be the same as that already described in connection with the first liquid developer.

The dispersant is preferably added to the carrier liquid at the rate from 0.01 wt % to 20 wt % for improving the dispersibility and preventing rise in viscosity of the carrier liquid due to addition of the dispersant. More preferably, the rate is substantially in a range from 0.1 wt %; to 10 wt %.

A rate of the total weight of the solid components such as the toner, charge director and dispersant with respect to the total weight of the liquid developer is preferably in a range from about 1 wt % to 90 wt %. For the purpose of reducing the total amount of the liquid developer used for the developing, and thereby facilitating the handling, the total rate of the solid components is more preferably in a range from 2 wt % to 50 wt %.

Specific examples of the fifth liquid developer will now be described below. The fifth liquid developer according to the invention is not restricted to the following developers.

Manufacturing of the Binder Resin

A polyester resin used as a binder resin in experimental examples, which will be described later, was produced in the same manner as that in the first liquid developer.

The polyester resin thus formed was 6500 in Mw, 2500 in Mn, 55.1° C. in Tg and 25.0 mgKOH/g in acid value.

Experimental examples of manufacturing of the liquid developer are as follows.

EXPERIMENTAL EXAMPLE 49

A mixture of 60 parts of the polyester resin and 40 parts of the yellow coloring agent Toner Yellow HGVP2155 (manufactured by Clariant Co., Ltd.) was kneaded at 180° C. for four hours by a kneader with three rolls, and thereby a high-concentration coloring agent mixture was prepared. This high-concentration coloring agent mixture was diluted with the foregoing polyester resin by a kneader so that the coloring resin mixture containing 15 wt % of PY180 was produced. The coloring resin mixture was sufficiently cooled, and then was roughly crushed by a cutter mill. Thereafter, the mixture was finely crushed by a jet mill (Nippon Pneumatic Kogyo Co., Ltd.) to produce coloring toner rough particles having an average particle diameter of about 10 μm. Thirty grams of the coloring toner rough particles were mixed with 70 grams of 0 grade solvent L solution containing 8 wt % of barium salt of petroleum sulfonic acid Sulfol Ba-30N (Matsumura Oil Reseach Corp.). Wet grinding was effected on this mixture by performing processing for 15 hours with a sand grinder (IGARASHI KIKAI SEIZO Co., Ltd.), a media formed of 170 cc of glass beads having a diameter of 1 mm, a ⅛-gallon vessel with water-jacket, a cooling water temperature of 20° C. and a disk rotation speed of 2000 rpm. In this manner, the high-concentration liquid developer having a volume average toner particle diameter of 1.58 μm was prepared.

The high-concentration liquid developer was diluted by adding 900 parts of 0 grade Solvent L solution containing 0.5 wt % of Sulfol Ba-30N to 100 parts of the above high-concentration liquid developer. Dispersing processing was effected on this mixture by a dispersing device T. K. autohomomixer M-type (Tokushu Kikai Kogyo Co., Ltd.) with 10000 rpm for 5 minutes. Thereby, the liquid developer 49 was produced.

EXPERIMENTAL EXAMPLE 50

A liquid developer 50 was produced in the same manner as the experimental example 49 except for that the content of Sulfol Ba-30N in the 0 grade Solvent L solution, which was added to the coloring toner rough particles in the wet grinding step, was not 8 wt % but 6 wt %. The toner had the volume average particle diameter of 2.85 μm.

EXPERIMENTAL EXAMPLE 51

A liquid developer 51 was produced in the same manner as the experimental example 49 except for that the wet grinding was performed not for 15 hours but for 20 hours. The toner had the volume average particle diameter of 1.04 μm.

EXPERIMENTAL EXAMPLE 52

A liquid developer 52 was produced in the same manner as the experimental example 49 except for that the wet grinding was performed not for 15 hours but for 20 hours, and the glass beads having a diameter of 0.5 mm were used for the wet grinding instead for those of 1 mm in diameter. The toner had the volume average particle diameter of 0.56 μm.

EXPERIMENTAL EXAMPLE 53

A liquid developer 53 was produced in the same manner as the experimental example 49 except for that the content of Sulfol Ba-30N in the 0 grade Solvent L solution, which was added to the coloring toner rough particles in the wet grinding step, was not 8 wt % but 6 wt %, and the amount of the glass beads used for the wet grinding was not 170 cc but 100 cc in volume. The toner had the volume average particle diameter of 4.92 μm.

EXPERIMENTAL EXAMPLE 54

A liquid developer 54 was produced in the same manner as the experimental example 49 except for that the content of Sulfol Ba-30N in the 0 grade Solvent L solution, which was added to the coloring toner rough particles in the wet grinding step, was not 8 wt % but 12 wt %. The toner had the volume average particle diameter of 0.43 μm.

EXPERIMENTAL EXAMPLE 55

A liquid developer 55 was produced in the same manner as the experimental example 49 except for that the wet grinding was performed not for 15 hours but for 5 hours. The toner had the volume average particle diameter of 6.33 μm.

EXPERIMENTAL EXAMPLE 56

A mixture of 30 grams of the yellow pigment Toner Yellow HGVP2155 (manufactured by Clariant Co., Ltd.) and 70 grams of 0 grade solvent L solution containing 8 wt % of barium salt of petroleum sulfonic acid Sulfol Ba-30N was prepared. Wet grinding was effected on this mixture by performing processing for 15 hours with a sand grinder, a media formed of 170 cc of glass beads having a diameter of 1 mm, a ⅛-gallon vessel with water-jacket, a cooling water temperature of 20° C. and a disk rotation speed of 2000 rpm. In this manner, the high-concentration liquid developer was prepared.

The high-concentration liquid developer was diluted by adding 900 parts of 0 grade Solvent L solution containing 0.5 wt % of Sulfol Ba-30N to 100 parts of the above high-concentration liquid developer. Dispersing processing was effected on this mixture by a dispersing device T. K. autohomomixer M-type with 10000 rpm for 5 minutes. Thereby, the liquid developer 56, in which the pigment was dispersed in the carrier liquid, was produced. This developer, in which the binder resin was not used for dispersing the pigment in the carrier liquid, could not achieve a high dispersibility of the pigment in the carrier liquid, and the pigment was condensed and deposited immediately after the production so that the particle diameter of the pigment could not be measured.

Then, description will be given on evaluation which was made on the liquid developers 49–56, and particularly on the color irregularity and resolution of the final images.

The color irregularity and resolution were evaluated by the actual image forming tests using the respective liquid developers and the image forming apparatus, of which schematic structure is shown in FIG. 1.

For the image formation, the photosensitive drum 1 rotated at a speed of 800 mm/sec in the direction of the arrow a in the figure, and was uniformly charged by the charger 2 to have the surface potential of about −500 V. The image exposing device 3 performed the image exposure to lower the surface potential of the exposed portion on the photosensitive drum 1 to about −30 V.

The developing roller 41 rotated at a speed of 1200 mm/sec in the direction of the arrow b opposite to the rotating direction of the photosensitive drum 1, and the developing gap of 100 $\mu$m was kept between the photosensitive drum 1 and the developing roller 41.

The bias potential applied to the developing roller 41 was determined such that the roller 41 had the surface potential which was intermediate the surface potentials of the exposed and unexposed portions of the photosensitive drum 1. However, various kinds of toner used in the respective liquid developers carry the different amounts of charges. Therefore, the final images would carry different amounts of toners adhered thereto if an equal bias potential war applied to the developing roller 41 in the respective examples. Accordingly, the bias potential applied to the developing roller 41 was appropriately adjusted in each example so that the final image might carry the toner at 0.25 mg/cm$^2$ in each example. For example, in the case of the liquid developer 49, the toner amount of 0.25 mg/cm$^2$ could be achieved in the final image by applying the bias voltage between about −300 V and about −400 V to the developing roller 41. Based on this potential, the carried toner amount could be increased by changing the bias potential toward the surface potential of the unexposed portion of the photosensitive drum 1. The transfer roller 6 carried a transfer potential of +1000 V. The thermal fixing roller pair of the fixing device 10 was heated to 150° C.

The color irregularity was evaluated with the apparatus shown in FIG. 1 as follows:

An electrostatic latent image, which has a belt-like form, and is 20 cm in the longitudinal direction (parallel to the rotation axis of the photosensitive drum 1) and 5 cm in the peripheral direction, was formed on the photosensitive drum 1, and was visualized to provide a belt-like image of 20 cm by 5 cm. The color was measured by a spectrocolorimeter CM-2002 (manufactured by Minolta Co., Ltd.) at several portions of the band-like image. These portions are all located in the center with respect to the rotating direction of the photosensitive drum, and are respectively located at the longitudinally central position and the positions spaced in the longitudinal direction by 5 cm from the opposite ends, respectively. The L* a* b* calorimetric system was used. The evaluation was made based on L* which is the value representing the lightness. Among the L*s at the foregoing three positions, the minimum value was divided by the maximum value. It was deemed that the quotient closer to 1 represented less irregularity in lightness and thus less irregularity in color. Depending on the value of (minimum L*)/(maximum L*), the irregularity was determined as follows:

0.95 5≦value<1: good (O)

0.9≦value<0.95: relatively good (Δ)

value<0.9: bad (x)

The values determined as good or relatively good are in the practically allowed range.

The resolution was evaluated with the apparatus in FIG. 1 as follows.

An electrostatic latent image of one-dot on/off line with 300 dpi was formed in the longitudinal direction on the photosensitive drum 1, and the visible line image was formed from this electrostatic latent image. The line image was observed with an optical microscope of a magnification of 30 times, and the evaluation was made as follows depending on the extent of the separation between the observed lines.

When all lines were separated in the view, the resolution was evaluated as good (O).

When only one or two among the ten lines were not separated in the view, the resolution was evaluated as relatively good (Δ).

When three or more among the ten lines were not separated in the view, the resolution was evaluated as bad (X).

The resolutions evaluated as good or relatively good are in the practically allowed ranged.

The following list shows the results of evaluations which were made on the color irregularity and resolution of the respective liquid developers

| | Diameter* | Irregularity* | Resolution |
|---|---|---|---|
| EX* 49 | 1.58 | O | O |
| EX* 50 | 2.85 | O | O |
| EX* 51 | 1.04 | O | O |
| EX* 52 | 0.56 | Δ | O |
| EX* 53 | 4.92 | O | Δ |
| EX* 54 | 0.43 | X | O |
| EX* 55 | 6.33 | O | X |
| EX* 56 | — | — | — |

Diameter*: volume average particle diameter
Irregularity*: color irregularities
EX*: experimental example According to the above result, the liquid developers of the experimental examples 49–53, in which the toner had the volume average particle diameters in a range from 0.5 $\mu$m to 5 $\mu$m, could provide the color irregularities and resolutions, which are good or relatively good, and are in the allowed ranges. The liquid developer of the experimental examples 54 caused a large color irregularity. This is probably due to the fact that the excessively small toner particle diameter caused irregularities in amount of PY180 contained in the toner. The resolution was bad in the liquid developer of the experimental example 55. This is probably due to the excessively large toner particle diameters. In the liquid developer of the experimental example 56, PY180 was not sufficiently dispersed, and therefore it was impossible to perform the measurement of the toner particle diameter as well as the evaluation of the color irregularity and resolution.

From the above, it can be understood that the fifth liquid developer, in which PY180 is contained in the binder resin and is dispersed in the carrier liquid, and the toner has the volume average particle diameter in the range from 0.5 $\mu$m to 5$\mu$m, can provide the images colored in the constant state without color irregularity and loss.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A liquid developer comprising:

a carrier liquid having an aniline point of 80° C. to 100° C.; and at least one compound selected from among Color Index Pigment Yellow 180, Color Index Solvent Yellow 162 and derivatives of these.

2. A liquid developer as defined in claim 1 wherein said carrier liquid is a mixture of at least two of hydrocarbon solvents.

3. A liquid developer as defined in claim 2 wherein said compound selected from among Color Index Pigment Yellow 180, Color Index Solvent Yellow 162 and derivatives thereof is dispersed in any of binders selected from among a thermoplastic saturated polyester resin and ethylenic copolymer.

4. A liquid developer as defined in claim 3, further comprising an organic acid metal salt.

5. A liquid developer comprising:

a carrier liquid having an aniline point of 80° C. to 100° C.;

toner; and at least one compound selected from among salicylic acid metal salt and derivatives thereof.

6. A liquid developer as defined in claim 5 wherein said carrier liquid is a mixture of at least two of hydrocarbon solvents.

7. A liquid developer as defined in claim 6 wherein said toner contains any of binders selected from among a thermoplastic saturated polyester resin and ethylenic copolymer, and said compound selected from among salicylic acid metal salt and derivatives thereof is dispersed in the toner.

8. A liquid developer as defined in claim 5 wherein said salicylic acid metal salt and derivatives thereof are represented by the following formula:

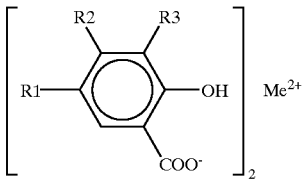

wherein R1, R2 and R3 are hydrogen atom, alkyl having 1 to 10 carbon atoms or aryl, and Me is a metal.

9. A liquid developer comprising:

a carrier liquid having an aniline point of 80° C. to 100° C.;

toner; and at least one compound selected from among borate-containing compound and derivatives thereof.

10. A liquid developer as defined in claim 9 wherein said carrier liquid is a mixture of at least two of hydrocarbon solvents.

11. A liquid developer as defined in claim 10 wherein said toner contains any of binders selected from among a thermoplastic saturated polyester resin and ethylenic copolymer, and said compound selected from among borate-containing compound and derivatives thereof is dispersed in said toner.

12. A liquid developer as defined in claim 9 wherein said borate-containing compound and derivatives thereof are represented by the following formula:

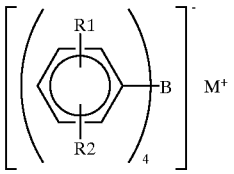

wherein R1 is hydrogen atom, halogen atom, lower alkyl or halomethyl, R2 is hydrogen atom or halomethyl, $M^+$ is selected from among metal cations; ammonium, alkylammonium, pyridinium, quinolinium, imidazolinium or like organic amine cations; sulfonium cations; and phosphonium cations.

13. A liquid developer as defined in claim 9 wherein said borate-containing compound is represented by the following formula:

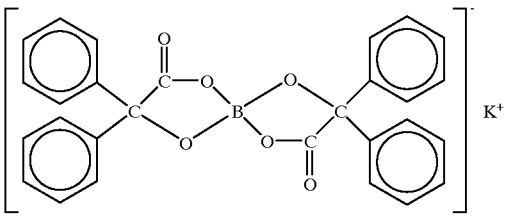

14. A liquid developer comprising:

a carrier liquid;

at least one compound selected from among an oil-soluble ionic surfactant having alkyl group(s) of at least 20 carbon atoms, and a copolymer of a monomer having a nitrogen-containing group and a long-chain (meth) acrylate; and toner containing at least one compound selected from among Color Index Pigment Yellow 180, Color Index Solvent Yellow 162 and derivatives of these.

15. A liquid developer as defined in claim 14 wherein said toner contains any of binders selected from among a thermoplastic saturated polyester resin and ethylenic copolymer.

16. A liquid developer as defined in claim 14 wherein said oil-soluble ionic surfactant is a petroleum sulfonic acid salt.

17. A liquid developer as defined in claim 14 wherein said carrier liquid is normal paraffin solvent or isoparaffin solvent.

18. A liquid developer comprising:

a carrier liquid; and toner containing Color Index Pigment Yellow 180 and having a volume average particle diameter in a range from 0.5 $\mu$m to 5 $\mu$m.

19. A liquid developer as defined in claim 18 wherein said toner contains any of binders selected from among a thermoplastic saturated polyester resin and ethylenic copolymer.

20. A liquid developer as defined in claim 18 further comprising:

an oil-soluble ionic surfactant.

21. A liquid developer as defined in claim 20 wherein said oil-soluble ionic surfactant is a petroleum sulfonic acid salt.

22. A liquid developer as defined in claim 18 wherein said carrier liquid is normal paraffin solvent or isoparaffin solvent.

* * * * *